US011149413B2

(12) United States Patent
Ishihara et al.

(10) Patent No.: US 11,149,413 B2
(45) Date of Patent: Oct. 19, 2021

(54) CONSTRUCTION MACHINE

(71) Applicant: HITACHI CONSTRUCTION MACHINERY CO., LTD., Tokyo (JP)

(72) Inventors: Shinji Ishihara, Tokyo (JP); Hidekazu Moriki, Tokyo (JP); Manabu Edamura, Tsuchiura (JP); Hiroshi Sakamoto, Tsuchiura (JP); Yasutaka Tsuruga, Tsuchiura (JP); Yuuichirou Morita, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 285 days.

(21) Appl. No.: 16/477,224

(22) PCT Filed: Mar. 5, 2018

(86) PCT No.: PCT/JP2018/008400
§ 371 (c)(1),
(2) Date: Jul. 11, 2019

(87) PCT Pub. No.: WO2018/168553
PCT Pub. Date: Sep. 20, 2018

(65) Prior Publication Data

US 2019/0345697 A1 Nov. 14, 2019

(30) Foreign Application Priority Data

Mar. 17, 2017 (JP) ..... JP2017-052973

(51) Int. Cl.
*E02F 9/26* (2006.01)
*E02F 3/43* (2006.01)
(Continued)

(52) U.S. Cl.
CPC ..... *E02F 9/265* (2013.01); *E02F 3/43* (2013.01); *E02F 9/2058* (2013.01); *E02F 9/22* (2013.01)

(58) Field of Classification Search
CPC . E02F 3/43; E02F 3/435; E02F 9/2058; E02F 9/22; E02F 9/264; E02F 9/265; E02F 3/439; E02F 9/20; E02F 9/26
See application file for complete search history.

(56) References Cited

U.S. PATENT DOCUMENTS 5,887,365 A * 3/1999 Fujishima ..... E02F 3/437 37/348
6,169,948 B1 * 1/2001 Fujishima ..... E02F 3/435 701/50
(Continued)

FOREIGN PATENT DOCUMENTS

JP 03-070001 A 3/1991
JP 07-102593 A 4/1995
(Continued)

OTHER PUBLICATIONS

International Preliminary Report on Patentability received in corresponding International Application No. PCT/JP2018/008400 dated Sep. 26, 2019.
(Continued)

*Primary Examiner* — Tyler J Lee
(74) *Attorney, Agent, or Firm* — Mattingly & Malur, PC

(57) ABSTRACT

A hydraulic excavator includes: a multijoint type front implement that is configured by coupling a plurality of driven members including a bucket; inertial measurement units that detect posture information about the plurality of driven members; and a calibration value computing section that computes calibration parameters used in calibration of detection results of the inertial measurement units; and a work position computing section that computes a relative
(Continued)

position of the bucket to the machine body on the basis of the detection results of the inertial measurement units and the computation result of the calibration value computing section, and the calibration value computing section computes the calibration parameters on the basis of the detection results of the inertial measurement units in a plurality of postures of the front implement in which a reference point set on any of the plurality of driven members in advance matches a reference position.

6 Claims, 16 Drawing Sheets

(51) Int. Cl.
*E02F 9/22* (2006.01)
*E02F 9/20* (2006.01)

(56) References Cited

U.S. PATENT DOCUMENTS 6,209,232 B1 * 4/2001 Ono ..... E02F 3/435 37/348
9,540,794 B2 * 1/2017 Iwamura ..... E02F 9/2025
9,556,583 B2 * 1/2017 Guo ..... E02F 9/2025
9,938,694 B2 * 4/2018 Matsuyama ..... E02F 9/2033
10,036,141 B2 * 7/2018 Yokoo ..... E02F 9/2012
10,501,911 B2 * 12/2019 Matsuyama ..... E02F 3/32
10,760,245 B2 * 9/2020 Morita ..... E02F 3/437
2009/0228169 A1 9/2009 Chiorean et al.
2013/0158788 A1 * 6/2013 Seki ..... E02F 9/264 701/34.4
2013/0166143 A1 * 6/2013 Seki ..... G01S 19/42 701/34.4
2014/0326039 A1 * 11/2014 Ikegami ..... F15B 15/2815 73/1.79
2015/0330060 A1 11/2015 Seki et al.
2016/0298316 A1 * 10/2016 Iwamura ..... E02F 9/267

FOREIGN PATENT DOCUMENTS

JP 07-150596 A 6/1995
JP 10-115517 A 5/1998
JP 2005-121437 A 5/2005
JP 2012-233353 A 11/2012
WO 2015/173920 A1 11/2015
WO 2017/072877 A1 5/2017

OTHER PUBLICATIONS

International Search Report of PCT/JP2018/008400 dated Jun. 5, 2018.

* cited by examiner

CONSTRUCTION MACHINE

TECHNICAL FIELD

The present invention relates to a construction machine having a front implement.

BACKGROUND ART

In recent years, to respond to intelligent construction, a construction machine that has a machine guidance function to display a posture of a work implement having driven members such as a boom, an arm, and a bucket, and a position of a work tool such as a bucket to an operator, and a machine control function to exercise control in such a manner that the work tool such as the bucket moves along a target work execution surface has been put into practical use. Typical functions of these functions include a function to display a position of a bucket tip end and an angle of the bucket of a hydraulic excavator on a monitor and a function to limit an action of the hydraulic excavator in such a manner that a distance by which the bucket tip end approaches the target work execution surface is equal to or smaller than a certain distance.

To realize such functions, it is necessary to compute the postures of the work implement, and higher precision of this posture computation enables higher-level work execution. To compute the postures of the work implement, it is necessary to detect rotation angles of the boom, the arm, and the bucket using sensors which are, for example, potentiometers or inertial measurement units. It is also necessary to accurately grasp mounting positions, angles, and the like of the sensors to realize high precision posture computation. However, mounting errors are generated in actual operation at a time of mounting the sensors to the construction machine; thus, to accurately compute the postures of the work implement of the construction machine, the construction machine needs to be configured with calibration means of some sort to correct these errors.

Examples of a calibration method of calibrating the mounting positions of the sensors mounted to the work implement include use of an external measuring device, for example, a total station. With this method, however, it is impossible to carry out calibration work in an environment in which the external measuring device is unavailable (for example, in a case in which the total station is used but a laser beam is poorly reflected in rainy weather) or at a work site where an operator capable of handling the external measuring device is absent. Moreover, measurement using the external measuring device requires man-hours for the measurement; thus, a calibration method without using the external measuring device is desired.

Examples of the calibration method without utilizing the external measuring device include a technique described in, for example, Patent Document 1. According to this technique, a construction machine configured with potentiometers at links of a work implement adapts a position of a work tool (for example, a bucket claw tip) to a specific reference plane extending in a longitudinal direction and corrects vertical positions of the work tool corresponding to a plurality of positions in the longitudinal direction of the work tool at this time.

PRIOR ART DOCUMENT

Patent Documents

Patent Document 1: JP-1995-102593-A

SUMMARY OF THE INVENTION

Problem to be Solved by the Invention

The conventional technique is intended to accurately compute a height of the bucket at a time of grounding the bucket by correcting a height of the bucket claw tip with a ground or the like set as the reference plane. However, the plurality of sensors installed in the work implement or the like exhibit inherent error characteristics different from one another. Owing to this, in a case in which the postures of the work implement (angles of the boom, the arm, and the bucket) differs from that at a time of correction, that is, in a case, for example, in which work is conducted on a working surface having a shape different from that of the reference plane (plane) used at the time of executing correction, errors of the sensors change to reduce precision of correction values, with the result that it is impossible to accurately compute the postures of the work implement.

The present invention has been achieved in the light of the above respects and an object of the present invention is to provide a construction machine capable of highly precisely computing a posture of a work implement with a simpler configuration.

Means for Solving the Problems

The present application includes a plurality of means for solving the problems. An example, there is provided a construction machine including: a multijoint type front work implement that is configured by coupling a plurality of driven members including a work tool and that is supported by a machine body of the construction machine in such a manner as to be rotatable in a perpendicular direction; posture information sensors that detect posture information about the plurality of driven members; and a front posture computing device that computes a posture of the multijoint type front work implement on the basis of detection information from the posture information sensors, an action of the multijoint type front work implement being controlled on the basis of the posture of the multijoint type front work implement computed by the front posture computing device. The construction machine is configured in such a manner that the front posture computing device includes: a reference position setting section that sets a reference position specified relatively to the machine body; a calibration value computing section that computes calibration parameters used in calibration of the detection information from the posture information sensors; and a work position computing section that computes a relative position of the work tool to the machine body on the basis of the detection information from the posture information sensors and a computation result of the calibration value computing section. Further, the construction machine is configured in such a manner that the calibration value computing section computes the calibration parameters on the basis of the detection information from the posture information sensors in a plurality of postures of the front work implement in which a reference point set on any of the plurality of driven members in advance matches the reference position set by the reference position setting section, which differ in a posture of at least one of the plurality of driven members, and the number of which corresponds to the number of the driven members.

Advantages of the Invention

According to the present invention, it is possible to appropriately control distribution flow rates to hydraulic actuators and improve operator's operability.

MODES FOR CARRYING OUT THE INVENTION

Embodiments of the present invention will be described hereinafter with reference to the drawings. In the present embodiments, a hydraulic excavator configured with a bucket as a work tool on a tip end of a front implement (front work implement) will be described by way of example of a construction machine. However, the present invention is also applicable to a hydraulic excavator configured with an attachment such as a breaker or a magnet other than the bucket.

Embodiment 1

Embodiment 1 of the present invention will be described with reference to FIGS. 1 to 8.

Figure 1:
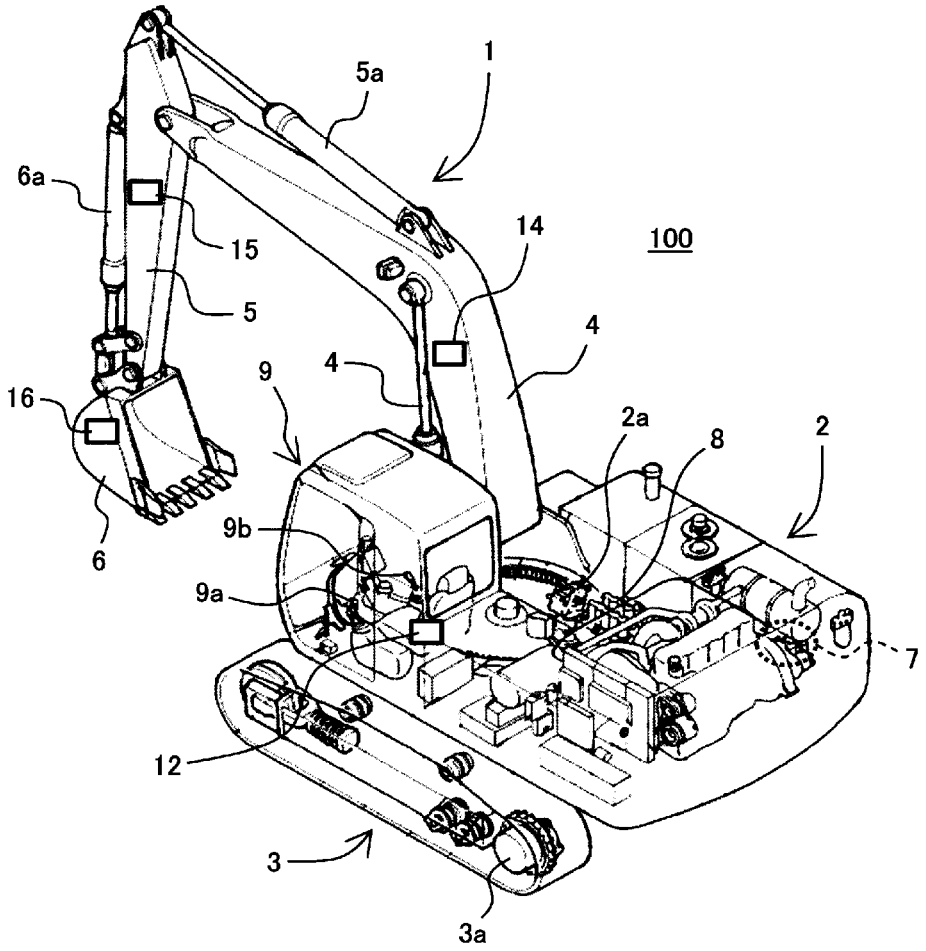
FIG. 1 is a schematic diagram of an outward appearance of a hydraulic excavator that is an example of a construction machine according to Embodiment 1.

FIG. 1 is a schematic diagram of an outward appearance of the hydraulic excavator that is an example of a construction machine according to Embodiment 1.

In FIG. 1, a hydraulic excavator 100 is configured with a multijoint type front implement (front work implement) 1 configured by coupling a plurality of driven members (a boom 4, an arm 5, and a bucket (work tool) 6) rotating in a perpendicular direction, and an upper swing structure 2 and a lower travel structure 3 configuring a machine body, and the upper swing structure 2 is provided swingably with respect to the lower travel structure 3. Furthermore, a base end of the boom 4 of the front implement 1 is supported by a front portion of the upper swing structure 2 in such a manner as to be rotatable in the perpendicular direction, one end of the arm 5 is supported by an end portion (tip end) other than the base end of the boom 4 in such a manner as to be rotatable in the perpendicular direction, and the bucket 6 is supported by the other end of the arm 5 in such a manner as to be rotatable in the perpendicular direction. The boom 4, the arm 5, the bucket 6, the upper swing structure 2, and the lower travel structure 3 are driven by a boom cylinder 4*a*, an arm cylinder 5*a*, a bucket cylinder 6*a*, a swing motor 2*a*, and left and right travel motors 3*a* (only one of which is depicted), respectively.

The boom 4, the arm 5, and the bucket 6 act on a plane including the front implement 1, and this plane is often referred to as "action plane," hereinafter. In other words, the action plane is a plane orthogonal to rotational axes of the boom 4, the arm 5, and the bucket 6, and can be set at a center in width directions of the boom 4, the arm 5, and the bucket 6.

Operation levers (operation devices) 9*a* and 9*b* that output operation signals for operating the hydraulic actuators 2*a* to 6*a* are provided in a cabin 9 of which an operator is on board. Although not depicted in FIG. 1, the operation levers 9*a* and 9*b* are tiltable longitudinally and horizontally, include sensors, not depicted, electrically detecting lever tilt amounts, that is, lever operation amounts that are the operation signals, and output the lever operation amounts detected by the sensors to a controller 19 (refer to FIG. 2) via electric interconnections. In other words, operating the hydraulic actuator 2*a* to 6*a* is allocated to longitudinal or horizontal directions of the operation levers 9*a* and 9*b*.

Actions of the boom cylinder 4*a*, the arm cylinder 5*a*, the bucket cylinder 6*a*, the swing motor 2*a*, and the left and right travel motors 3*a* are controlled by causing a control valve 8 to control directions and flow rates of hydraulic working fluids supplied to the hydraulic actuators 2*a* to 6*a* from a hydraulic pump device 7 driven by a prime mover such as an engine or an electric motor which is not depicted. The control valve 8 is based on a drive signal (pilot pressure) output from a pilot pump, not depicted, via solenoid proportional valves. The controller 19 controls the solenoid proportional valves on the basis of the operation signals from the operation levers 9*a* and 9*b*, thereby controlling the actions of the hydraulic actuators 2*a* to 6*a*.

It is noted that the operation levers 9*a* and 9*b* may be hydraulic pilot type operation levers, and may be configured to supply pilot pressures in response to operation directions and operation amounts of the operation levers 9*a* and 9*b* operated by an operator to the control valve 8 as drive signals, and to drive the hydraulic actuators 2*a* to 6*a*.

Inertial measurement units (IMU) 12 and 14 to 16 are disposed in the upper swing structure 2, the boom 4, the arm 5, and the bucket 6 as posture sensors, respectively. In a case in which it is necessary to distinguish these inertial measurement units, the inertial measurement units will be referred to as "machine body inertial measurement unit 12," "boom inertial measurement unit 14," "arm inertial measurement unit 15," and "bucket inertial measuring device 16."

The inertial measurement units 12 and 14 to 16 measure angular velocities and accelerations. If considering a case in which the upper swing structure 2 and the driven members 4 to 6 in which the inertial measurement units 12 and 14 to 16 are disposed are at a standstill, it is possible to detect directions (postures: posture angles θ to be described later) of the upper swing structure 2 and the driven members 4 to 6 on the basis of directions of gravitational accelerations (that is, vertically downward directions) in IMU coordinate systems set to the inertial measurement units 12 and 14 to 16 and mounting states of the inertial measurement units 12 and 14 to 16 (that is, relative position relationships between the inertial measurement units 12 and 14 to 16 and the upper swing structure 2 and the driven members 4 to 6). Here, the inertial measurement units 14 to 16 configure posture information sensors that detect information about respective postures of the plurality of driven members (hereinafter, referred to as "posture information").

It is noted that the posture information sensors are not limited to the inertial measurement units but that tilting angle sensors, for example, may be used as the posture information sensors. Alternatively, potentiometers may be disposed in coupling portions of coupling the driven members 4 to 6 to detect relative directions of (posture information about) the upper swing structure 2 and the driven members 4 to 6 and to obtain the postures of the driven members 4 to 6 from detection results. In another alternative, stroke sensors may be disposed in the boom cylinder 4*a*, the arm cylinder 5*a*, and the bucket cylinder 6*a* and configured to calculate relative directions of (posture information about) connection portions of connecting the upper swing structure 2 and the driven members 4 to 6 from amounts of change in stroke, and to obtain the postures (posture angles θ) of the driven members 4 to 6 from calculation results.

Figure 2:
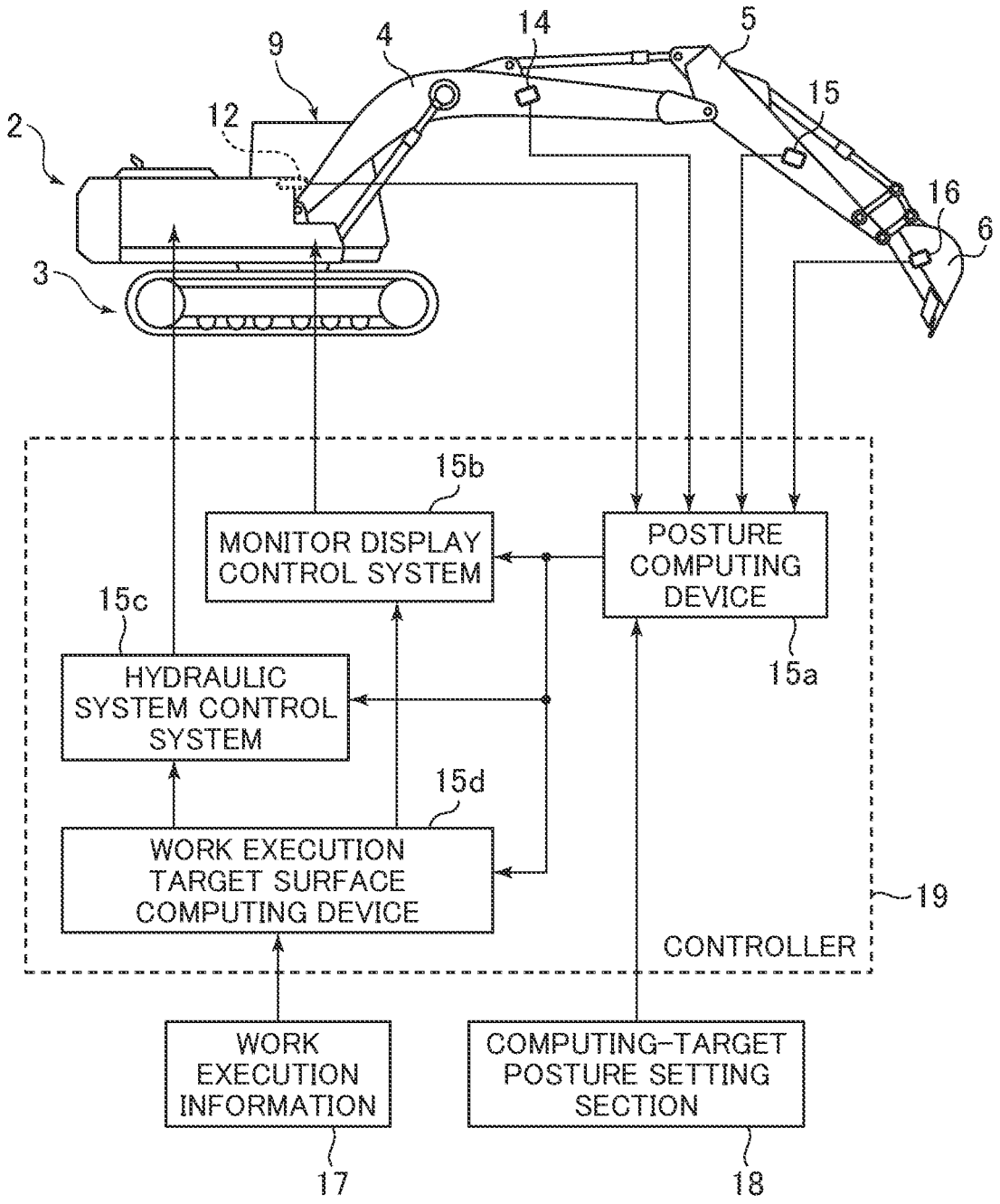
FIG. 2 is a schematic diagram depicting part of processing functions of a controller on board of the hydraulic excavator.

FIG. 2 is a schematic diagram depicting part of processing functions of the controller on board of the hydraulic excavator.

In FIG. 2, the controller 19 has various functions to control the actions of the hydraulic excavator 100, and part of the various functions include a posture computing device 15*a*, a monitor display control system 15*b*, a hydraulic system control system 15*c*, and a work execution target surface computing device 15*d*.

The posture computing device 15*a* performs a posture computation process (to be described later) for computing a posture of the front implement 1 on the basis of detection results from the inertial measurement units 12 and 14 to 16 and an input from a computation posture setting section 18 (to be described later) disposed in the cabin 9.

The work execution target surface computing device 15*d* computes a work execution target surface defining a target shape of an object to be worked on the basis of work execution information 17 such as a three-dimensional working drawing stored in a storage device, not depicted, by a work manager and the posture of the front implement 1 computed by the posture computing device 15*a*.

The monitor display control system 15*b*, which controls display of a monitor provided in the cabin 9 and which is not depicted, computes an instruction content of operation support for the operator on the basis of the work execution target surface computed by the work execution target surface computing device 15*d* and the posture of the front implement 1 computed by the posture computing device 15*a*, and displays the instruction content on the monitor of the cabin 9. In other words, the monitor display control system 15*b* plays part of functions as a machine guidance system that supports operator's operation by, for example, displaying on the monitor the posture of the front implement 1 having the driven members such as the boom 4, the arm 5, and the bucket 6 and a tip end position and an angle of the bucket 6.

The hydraulic system control system 15*c*, which controls a hydraulic system for the hydraulic excavator 100 configured with the hydraulic pump device 7, the control valve 8, and the hydraulic actuators 2*a* to 6*a*, computes the actions of the front implement 1 on the basis of the work execution target surface computed by the work execution target surface computing device 15*d* and the posture of the front implement 1 computed by the posture computing device 15*a*, and controls the hydraulic system for the hydraulic excavator 100 to realize the actions of the front implement 1. In other words, the hydraulic system control system 15*c* plays part of functions as a machine control system that limits the actions in such a manner, for example, that a distance by which a tip end of the work tool such as the bucket 6 approaches the work execution target surface does not exceed a certain distance and that the work tool (for example, a claw tip of the bucket 6) moves along the work execution target surface.

Figure 3:
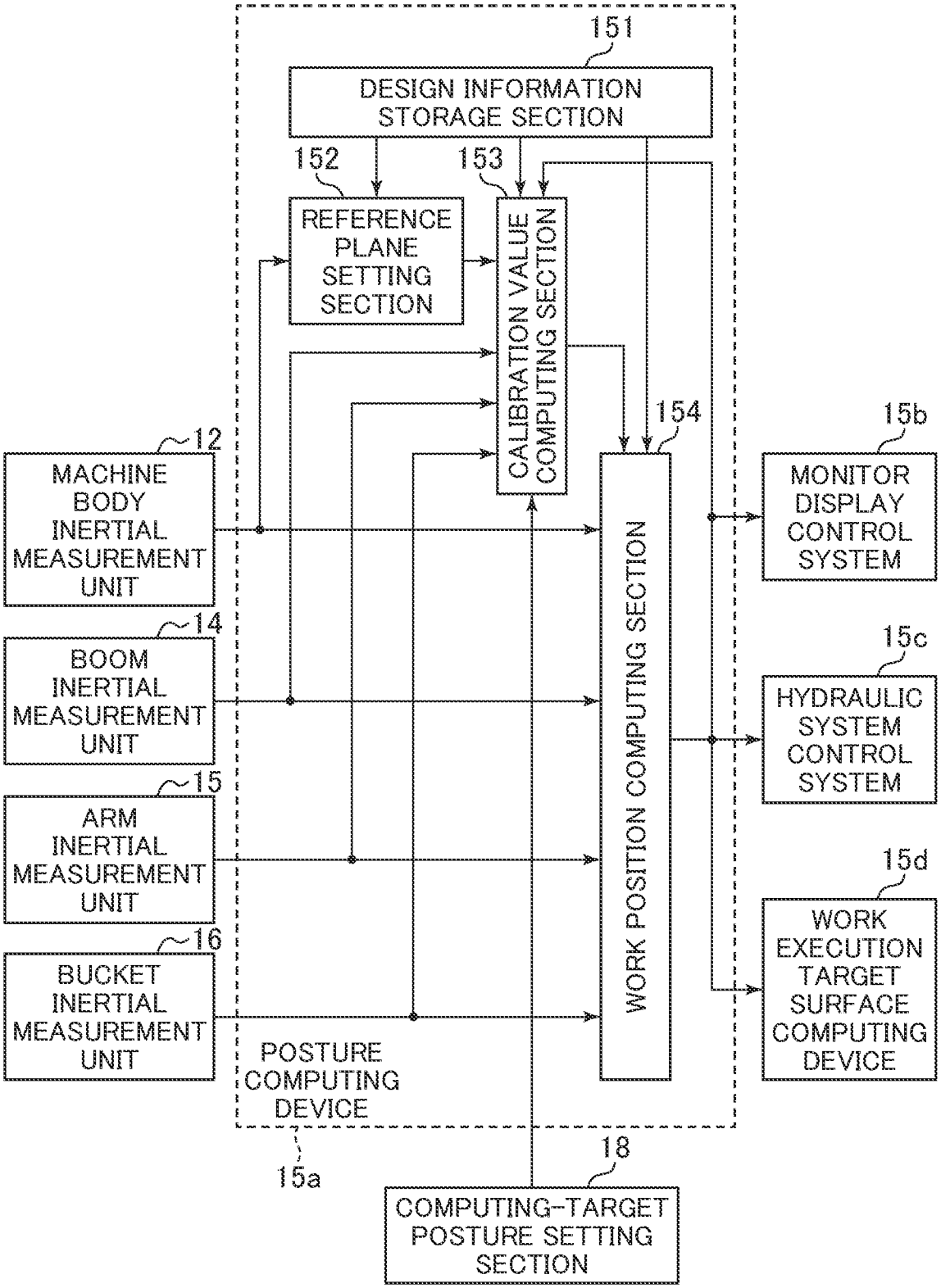
FIG. 3 is a functional block diagram schematically depicting processing functions of a posture computing device in the controller.
Figure 4:
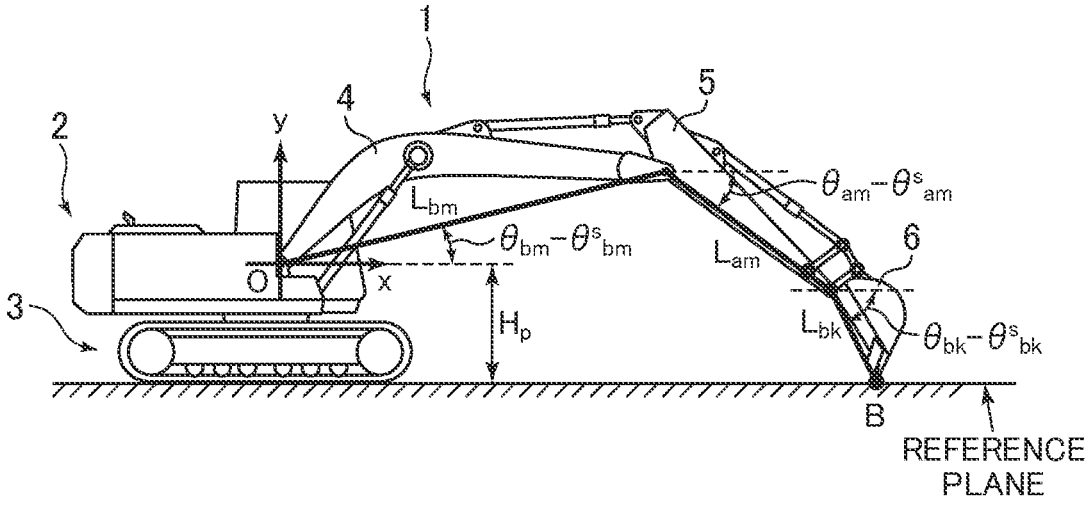
FIG. 4 is a side view schematically depicting a relationship between a front implement coordinate system defined in Embodiment 1 and the hydraulic excavator.

FIG. 3 is a functional block diagram schematically depicting processing functions of the posture computing device in the controller. In addition, FIG. 4 is a side view schematically depicting a relationship between a front implement coordinate system defined in Embodiment 1 and the hydraulic excavator.

In FIG. 3, the posture computing device 15*a* performs the posture computation process for computing the posture of the front implement 1 on the basis of the detection results from the inertial measurement units 12 and 14 to 16 and the input from the computation posture setting section 18 disposed in the cabin 9, and has functional sections such as a design information storage section 151, a reference plane setting section 152, a calibration value computing section 153, and a work position computing section 154.

The design information storage section 151 is a storage device such as a ROM (Read Only Memory) or a RAM (Random Access Memory) to which information about machine body dimensions of the construction machine is written. Examples of the machine body dimensions stored in the design information storage section 151 include a width (machine body width) and a length of the upper swing structure 2, a swing central position of the upper swing structure 2, a mounting position of the front implement 1 at which the front implement 1 is mounted to the upper swing structure 2 (that is, a position of a boom foot pin) and lengths of the boom 4, the arm 5, and the bucket 6.

The reference plane setting section 152 sets a reference plane used in a parameter calibration process (to be described later) performed by the calibration value computing section 153 on the basis of the machine body dimensions obtained from the design information storage section 151.

The reference plane set by the reference plane setting section 152, the detection results of the boom inertial measurement unit 14, the arm inertial measurement unit 15, and the bucket inertial measuring device 16, and a computation result of the work position computing section 154 are input to the calibration value computing section 153, and the calibration value computing section 153 computes calibration parameters for calibrating the detection results from the inertial measurement units 14 to 16.

The work position computing section 154 computes a relative position of the work tool provided on the tip end of the front implement 1 (claw tip position of the bucket 6 in Embodiment 1) with respect to the machine body on the basis of the detection results from the inertial measurement units 12 and 14 to 16 and a computation result of the calibration value computing section 153.

A principle of the posture computation process will now be described.

As depicted in FIG. 4, in Embodiment 1, a front implement coordinate system that is an orthogonal coordinate system defining an x-axis in a longitudinal direction of the upper swing structure 2 (positive in a forward direction) and a z-axis in a vertical direction (positive in an upward direction) with the position of the boom foot pin (that is, a rotation center of the boom 4 with respect to the upper swing structure 2) assumed as an origin O (0, 0) is used. In other words, the front implement coordinate system is set on the action plane of the front implement 1.

If it is assumed that a distance between a rotation fulcrum of the boom 4 (position of the boom foot pin) and a rotation fulcrum of the arm 5 (coupling portion of coupling the boom 4 and the arm 5) is a boom length $L_{bm}$, a distance between the rotation fulcrum of the arm 5 and a rotation fulcrum of the bucket 6 (coupling portion of coupling the arm 5 and the bucket 6) is an arm length $L_{am}$, and a distance between the rotation fulcrum of the bucket 6 and a reference point B of the bucket 6 (which illustrates a case of setting the tip end (claw tip) of the bucket 6 as the reference point B in advance) is a bucket length $L_{bk}$, then coordinate values (x, z) of the reference point B in the front implement coordinate system can be obtained from the following Equations (1) and (2), where angles (posture angles) formed between the boom 4, the arm 5, and the bucket 6 (to be precise, directions of the boom length $L_{bm}$, the arm length $L_{am}$, and the bucket length $L_{bk}$) and a horizontal direction are $\theta_{bm}$, $\theta_{am}$, and $\theta_{bk}$, respectively.

[Equation 1]

$$x=L_{bm}\cos(\theta_{bm}-\theta_{bm}^{s})+L_{am}\cos(\theta_{am}-\theta_{am}^{s})+L_{bk}\cos(\theta_{bk}-\theta_{bk}^{s}) \quad (1)$$

[Equation 2]

$$x=L_{bm}\sin(\theta_{bm}-\theta_{bm}^{s})+L_{am}\sin(\theta_{am}-\theta_{am}^{s})+L_{bk}\sin(\theta_{bk}-\theta_{bk}^{s}) \quad (2)$$

It is noted that the posture angles $\theta_{bm}$, $\theta_{am}$, and $\theta_{bk}$ indicate positive values above the horizontal direction and negative values below the horizontal direction.

Here, $\theta^s$ is a calibration parameter and can be obtained from the following Equation (3), where a true value of each posture angle is $\theta'$, on the basis of assumption that the posture angles $\theta$ ($\theta_{bm}$, $\theta_{am}$, and $\theta_{bk}$) detected by the posture information sensors (inertial measurement units 14 to 16 in Embodiment 1) or the posture angles $\theta$ computed from the posture information have offset errors.

[Equation 3]

$$\theta'=\theta+\theta^{s} \quad (3)$$

In Equations (1) and (2), the calibration parameters are defined as $\theta^s_{bm}$, $\theta^s_{am}$, and $\theta^s_{bk}$ to correspond to the posture angles $\theta_{bm}$, $\theta_{am}$, and $\theta_{bk}$, respectively.

The calibration value computing section 153 computes the calibration parameters $\theta^s_{bm}$, $\theta^s_{am}$, and $\theta^s_{bk}$ on the basis of Equation (2). Specifically, a known value of z is set to a left side of Equation (2) and the detection results (posture angles $\theta_{bm}$, $\theta_{am}$, and $\theta_{bk}$) from the inertial measurement units 14 to 16 (posture information sensors) are set to a right side of Equation (2) by disposing the reference point of the work tool of the front implement 1 (here, the reference point B set to the claw tip of the bucket 6) on the reference plane (set by the reference plane setting section 152) to which the known value of z is given, whereby the calibration value computing section 153 computes the calibration parameters $\theta^s_{bm}$, $\theta^s_{am}$, and $\theta^s_{bk}$. Since the lengths that are the boom length $L_{bm}$, the arm length $L_{am}$, and the bucket length $L_{bk}$ do not greatly change during short-time work, values given by the design information storage section 151 are handled as constants.

In a case of setting the position (height) of the reference point B to the known value $z_{set}$, Equation (2) can be expressed by the following Equation (4).

[Equation 4]

$$z_{set}=L_{bm}\sin(\theta_{bm}-\theta^{s}_{bm})+L_{am}\sin(\theta_{am}-\theta^{s}_{am})+L_{bk}\sin(\theta_{bk}-\theta^{s}_{bk}) \quad (4)$$

In Equation (4), the number of unknown variables is three, that is, the unknown variables are the calibration parameters $\theta^s_{bm}$, $\theta^s_{am}$, and $\theta^s_{bk}$, and the number is equal to the number of inertial measurement units 14 to 16 disposed in the plurality of driven members 4 to 6. Therefore, if at least three simultaneous equations different in at least one of the posture angles $\theta_{bm}$, $\theta_{am}$, and $\theta_{bk}$ in Equation (4) can be set up, the calibration parameters $\theta^s_{bm}$, $\theta^s_{am}$, and $\theta^s_{bk}$ can be determined.

It is noted that even in a case in which the number of driven members is equal to or larger than four (in other words, the number of calibration parameters is equal to or larger than four), those calibration parameters can be determined if simultaneous equations as many as the driven members configuring the front implement 1 can be set up.

(Setting of Reference Plane: Reference Plane Setting Section 152)

In Embodiment 1, a case of assuming a ground as the reference plane will be given by way of example, as depicted in FIG. 4 in a case of disposing the hydraulic excavator 100 on the substantially leveled ground. When the reference point B of the bucket 6 is disposed on and caused to match this reference plane, the height of the reference point B corresponds to a position lower than the origin O by a height of the boom foot pin; thus, the following Equation (5) is established.

[Equation 5]

$$z_{set}=-Hp \tag{5}$$

Setting the reference plane in this way makes it possible to create the reference plane without using a special tool. While precision of Equation (5) is possibly reduced in a case in which the ground is irregular, it is possible to ensure the precision of Equation (5) and realize more effective computation of the calibration parameters by setting a ground paved with concrete, an iron plate, or the like as the reference plane.

(Capture of Posture Angles $\theta_{bm}$, $\theta_{am}$, and $\theta_{bk}$: Calibration Value Computing Section 153)

Figure 5:
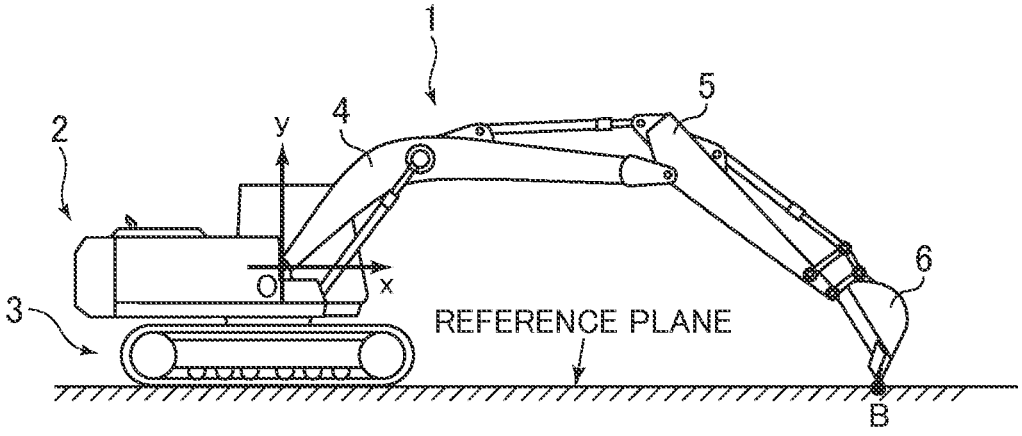
FIG. 5 is a diagram depicting an example of a posture of a front implement in a case of capturing posture angles.
Figure 6:
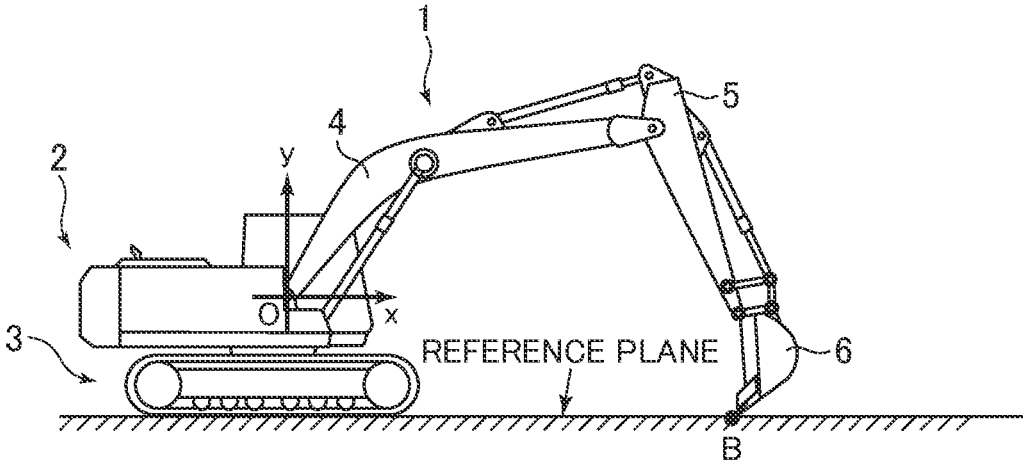
FIG. 6 is a diagram depicting an example of the posture of the front implement in the case of capturing posture angles.
Figure 7:
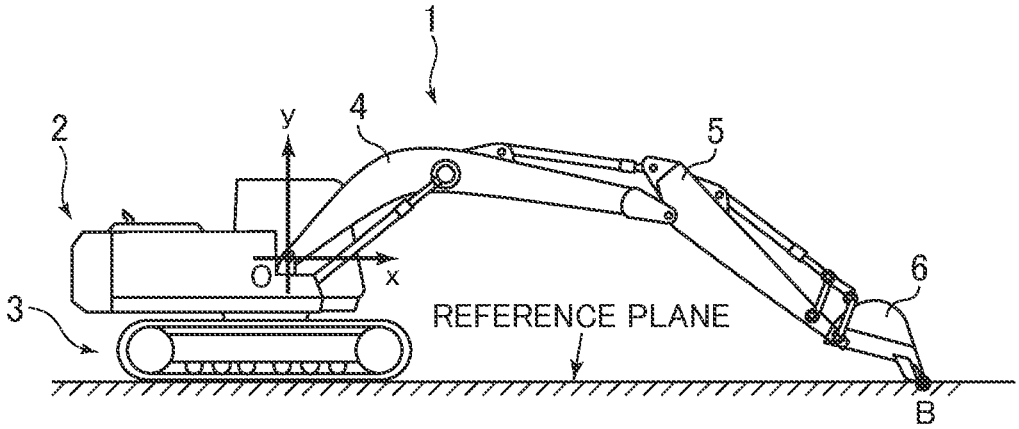
FIG. 7 is a diagram depicting an example of the posture of the front implement in the case of capturing posture angles.

FIGS. 5 to 7 depict examples of the posture of the front implement in a case of capturing the posture angles. FIG. 5 depicts a state of disposing the reference point B of the bucket 6 on the reference plane (ground) in a state in which the arm 5 has sufficient operation ranges in crowding and dumping directions, FIG. 6 depicts a state of disposing the reference point B of the bucket 6 on the reference plane (ground) in a state in which crowding of the arm 5 is greater than that in the case depicted in FIG. 5, and FIG. 7 depicts a state of disposing the reference point B of the bucket 6 on the reference plane (ground) in a state in which dumping of the arm 5 is greater than that in the case depicted in FIG. 5.

The posture in which the calibration parameters $\theta^s_{bm}$, $\theta^s_{am}$, and $\theta^s_{bk}$ are computed is set (that is, the posture angles $\theta_{bm}$, $\theta_{am}$, and $\theta_{bk}$ are captured) by operator's operating the computation posture setting section 18 provided in the cabin 9. It is noted that the computation posture setting section 18 is realized by, for example, one of functions of a switch provided in the cabin 9 or a GUI (Graphical User Interface) that functions integrally with a display device such as the monitor. Furthermore, lever operation interlocked with an action of the calibration value computing section 153 (for example, pulling a trigger in a case of a trigger lever device) may be set as an opportunity of capture, or the posture angles $\theta_{bm}$, $\theta_{am}$, and $\theta_{bk}$ may be automatically captured in a case in which the lever is not operated for certain time after the posture is taken for capturing the posture angles $\theta_{bm}$, $\theta_{am}$, and $\theta_{bk}$.

As depicted in FIGS. 5 to 7, capturing the posture angles $\theta_{bm}$, $\theta_{am}$, and $\theta_{bk}$ in a plurality of postures of the front implement 1 that differ in the posture of at least one of the plurality of driven members 4 to 6 makes it possible to set up three simultaneous equations in which at least one of the posture angles $\theta_{bm}$, $\theta_{am}$, and $\theta_{bk}$ different in at least one of the posture angles $\theta_{bm}$, $\theta_{am}$, and $\theta_{bk}$. Needless to say, capturing the posture angles $\theta_{bm}$, $\theta_{am}$, and $\theta_{bk}$ while the upper swing structure 2 is swung without changing the posture of the front implement 1 is handled as one posture.

It is considered that the posture of the front implement 1 as depicted in FIGS. 5 to 7 is influenced by errors in sensor characteristics of the inertial measurement units 14 to 16 or errors in a ground state. Therefore, the posture computing device 15*a* may be configured such that with the front implement 1 taking yet another posture, simultaneous equations more than the calibration parameters $\theta^s_{bm}$, $\theta^s_{am}$, and $\theta^s_{bk}$ are set up to perform computation, and the calibration parameters $\theta^s_{bm}$, $\theta^s_{am}$, and $\theta^s_{bk}$ are computed by, for example, a method of least squares.

Figure 8:
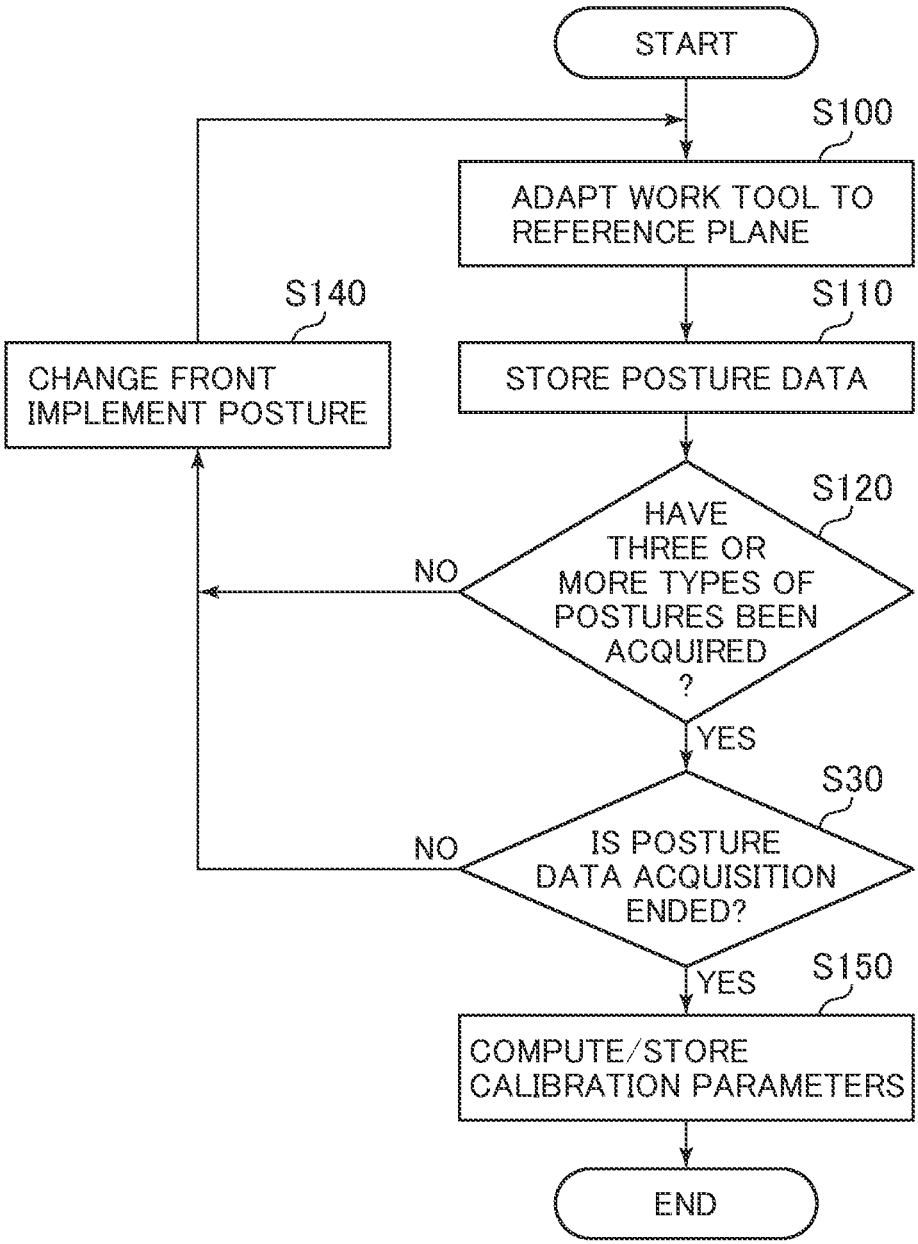
FIG. 8 is a flowchart depicting a posture computation process according to Embodiment 1.

FIG. 8 is a flowchart depicting the posture computation process.

In FIG. 8, first, in a state of determining the posture of the front implement 1 (for example, any of the states of FIGS. 5 to 7), the reference point B of the work tool (bucket 6) is adapted to the reference plane (Step S100). By operating the computation posture setting section 18 in this state, the posture angles $\theta_{bm}$, $\theta_{am}$, and $\theta_{bk}$ are captured as posture data in this posture and stored in the storage section, not depicted, in the calibration value computing section 153 (Step 110). Next, it is determined whether the posture data has been acquired in equal to or larger than three types of postures of the front implement 1 (Step S120). In a case in which a determination result is NO, the posture of the front implement 1 is changed to another posture in which posture data is not acquired yet (Step S140) and processes in Steps S100 and S110 are repeated. Furthermore, in a case in which the determination result of Step S120 is YES, it is determined whether to end posture data acquisition (Step S130). This determination may correspond to a case of displaying a screen on the display device such as the monitor in the cabin 9 to determine whether to continue acquiring the posture data and operator's operating the computation posture setting section 18 on an as-needed basis. Alternatively, the posture computing device 15*a* may be configured to set the number of times equal to or larger than four (that is, larger than the number of the calibration parameters $\theta^s_{bm}$, $\theta^s_{am}$, and $\theta^s_{bk}$ as the unknown variables) in advance and to determine whether the number of times is satisfied. In a case in which a determination result of Step S130 is NO, processes of Steps S140, S100, and S110 are repeated. Furthermore, in a case in which the determination result of Step S130 is YES, then simultaneous equations related to Equation (4) are set up using the obtained posture angles $\theta_{bm}$, $\theta_{am}$, and $\theta_{bk}$, the calibration parameters $\theta^s_{bm}$, $\theta^s_{am}$ and $\theta^s_{bk}$ are computed and stored in the calibration value computing section 153, a computation result is output to the work position computing section 154 (Step S150), and the process is ended.

Advantages of Embodiment 1 configured as described above will be described while comparing the advantages with those of the conventional technique.

Figure 26:
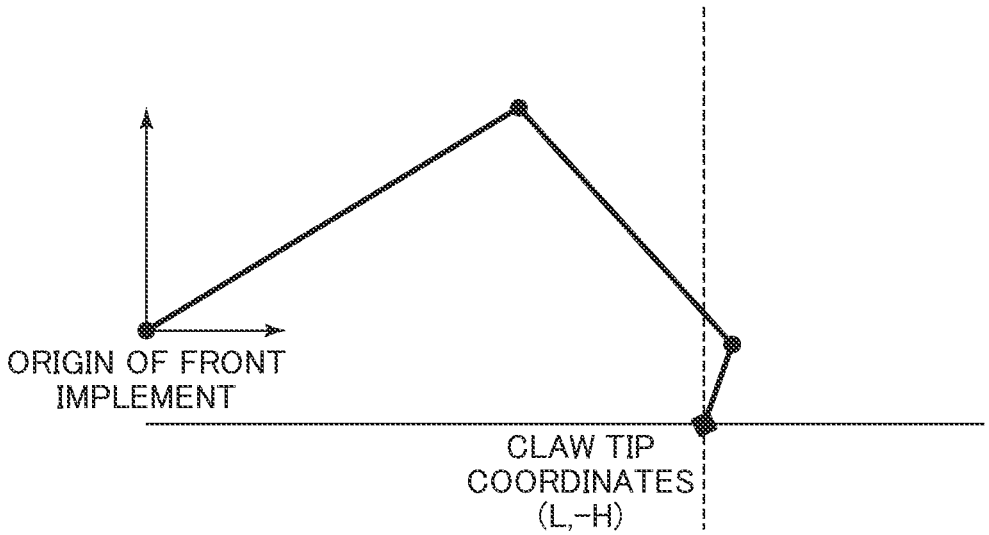
FIG. 26 is a diagram depicting a boom, an arm, and a bucket of a hydraulic excavator according to a conventional technique by a three-link mechanism, schematically depicting coordinates of a claw tip position of the bucket from an origin of a front implement coordinate system, and depicting work of forming a level.
Figure 27:
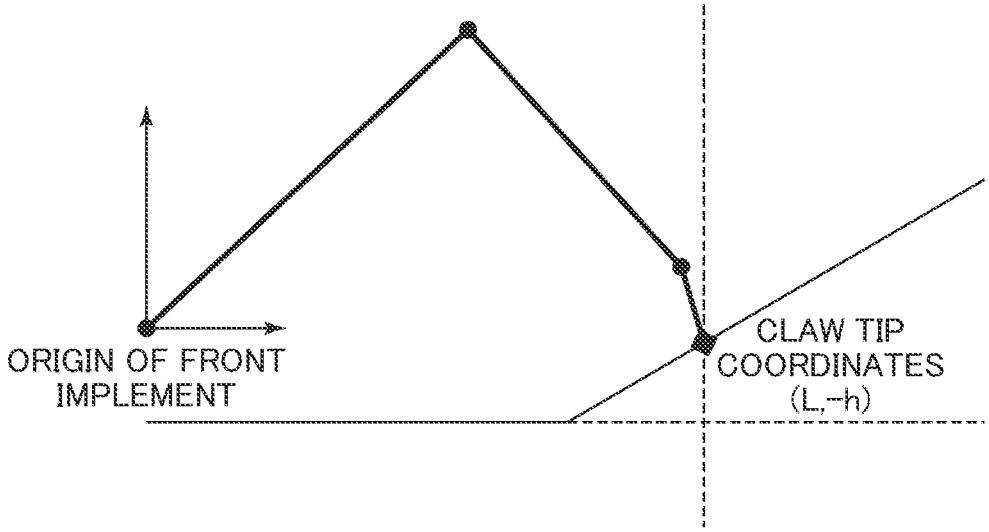
FIG. 27 is a diagram depicting the boom, the arm, and the bucket of the hydraulic excavator according to the conventional technique by the three-link mechanism, schematically depicting the coordinates of the claw tip position of the bucket from the origin of the front implement coordinate system, and depicting work of forming a slope such as a face of slope.

FIGS. 26 and 27 are diagrams depicting the boom, the arm, and the bucket of the hydraulic excavator according to the conventional technique by a three-link mechanism, and schematically depicting coordinates of the claw tip position of the bucket from the origin of the front implement coordinate system (defined as the position of the boom foot pin). FIG. 26 depicts work of forming a level and FIG. 27 depicts work of forming a slope such as a face of slope.

As can be understood from FIGS. 26 and 27, the position of the work tool with respect to a swing longitudinal direction is equally x=L in each work; however, the position of the work tool with respect to the vertical direction is y=−H in the work of FIG. 26 and y=−h in the work of FIG. 27 and the position differs in value between the work of FIG. 26 and that of FIG. 27. The conventional technique is intended to accurately compute the height of the bucket at the time of grounding the bucket by correcting the height of the bucket claw tip with the ground or the like assumed as the reference plane. A plurality of sensors installed in the work implement exhibit inherent error characteristics different from one another. Therefore, in a case of carrying out work on a surface at a different slope from that of the surface after making correction as depicted in FIG. 27, the posture of the front implement (angles of the boom, the arm, and the bucket) differs from that at the time of calibration; thus, a correction amount in the vertical direction naturally differs from that at the time of calibration. The conventional technique, however, is incapable of handling the case in which the posture of the work implement (angles of the boom, the arm, and the bucket) differs from that at the time of correction. In other words, in a case, for example, in which work is carried out on a working surface having a shape different from that of the reference plane (plane) used at the time of executing correction, errors of the sensors change to reduce the precision of correction values, with the result that it is impossible to accurately compute the posture of the work implement.

In Embodiment 1, by contrast, the hydraulic excavator 100 includes: the multijoint type front implement 1 that is configured by coupling the plurality of driven members (the boom 4, the arm 5, and the bucket 6) including the bucket 6 and that is supported by the upper swing structure 2 of the hydraulic excavator 100 in such a manner as to be rotatable in the perpendicular direction; the inertial measurement units 14 to 16 that detect posture information about the plurality of driven members 4 to 6, respectively; and the posture computing device 15*a* that computes the posture of the multijoint type front implement 1 on the basis of the detection results of the inertial measurement units 14 to 16, and controls the action of the multijoint type front implement 1 on the basis of the posture of the multijoint type front implement 1 computed by the posture computing device 15*a*, and the hydraulic excavator 100 is configured in such a manner that the posture computing device 15*a* includes the reference plane setting section 152 that sets the reference plane specified relatively to the upper swing structure 2; the calibration value computing section 153 that computes the calibration parameters $\theta^s_{bm}$, $\theta^s_{am}$, and $\theta^s_{bk}$ used in calibration of the detection results of the inertial measurement units 14 to 16; and the work position computing section 154 that computes the relative position of the bucket 6 to the upper swing structure 2 on the basis of the detection results of the inertial measurement units 14 to 16 and the computation result of the calibration value computing section 153, and that the calibration value computing section 153 computes the calibration parameters on the basis of the detection results of the inertial measurement units 14 to 16 in the plurality of postures of the front implement 1 in which the reference point set on any of the plurality of driven members 4 to 6 in advance matches the reference plane, which differ in the posture of at least one of the plurality of driven members 4 to 6, and the number of which corresponds to the number of the driven members 4 to 6. Therefore, it is possible to highly precisely compute the posture of the work implement with the simpler configuration.

In Embodiment 1, the hydraulic excavator 100 is configured in such a manner as to set the reference plane for which a value in a z-axis direction is known, and to compute the calibration parameters $\theta^s_{bm}$, $\theta^s_{am}$, and $\theta^s_{bk}$ using Equation (2) for the z-axis direction. However, the present invention is not limited to this configuration and the hydraulic excavator 100 may be configured, for example, in such a manner as to set the reference plane for which a value in an x-axis direction is known and to compute the calibration parameters $\theta^s_{bm}$, $\theta^s_{am}$, and $\theta^s_{bk}$ using Equation (1) for the x-axis direction. In another alternative, the hydraulic excavator 100 may be configured in such a manner as to set the reference position for which values in the z-axis and x-axis directions are known and to compute the calibration parameters $\theta^s_{bm}$, $\theta^s_{am}$, and $\theta^s_{bk}$ using Equations (1) and (2).

Modification of Embodiment 1

A modification of Embodiment 1 will be described with reference to FIG. 9.

Figure 9:
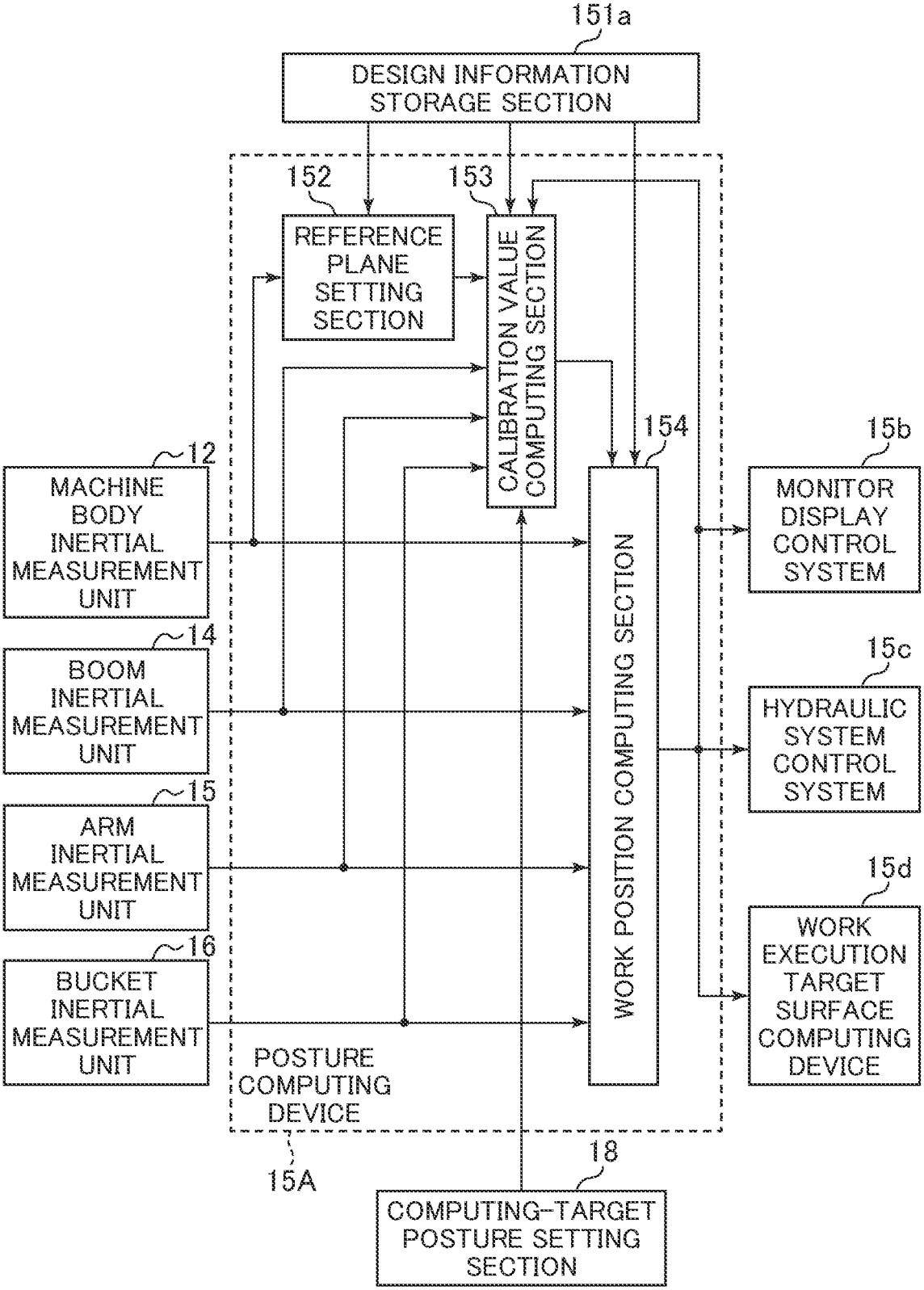
FIG. 9 is a functional block diagram schematically depicting processing functions of a posture computing device in the controller according to a modification of Embodiment 1.

FIG. 9 is a functional block diagram schematically depicting processing functions of a posture computing device in the controller according to the present modification. In FIG. 9, similar members to those in Embodiment 1 are denoted by the same reference symbols and description thereof will be omitted.

The present modification illustrates a case of disposing the design information storage section outside of the posture computing device. In the present modification, as depicted in FIG. 9, a design information storage section 151*a* is disposed outside of a posture computing device 15A, and the reference plane setting section 152, the calibration value computing section 153, and the work position computing section 154 acquire design information from the posture computing device 15A. The other configurations are similar to those in Embodiment 1.

The present modification configured as described above can obtain similar advantages to those of Embodiment 1.

Furthermore, the present modification is suitable for changing the design information by replacing the design information storage section 151*a* in a case in which the height of the boom foot pin has changed by replacing crawler belts of the lower travel structure 3 or a case in which the arm length has changed by replacing the arm by an arm of special specifications.

Another modification of Embodiment 1

Another modification of Embodiment 1 will be described with reference to FIGS. 10 to 13.

In the present modification, a method of setting $z_{set}$ is changed from that in Embodiment 1.

FIGS. 10 to 13 are diagrams each depicting an example of a relationship between the reference plane and the posture of the front implement in the case of capturing the posture angles.

Figure 10:
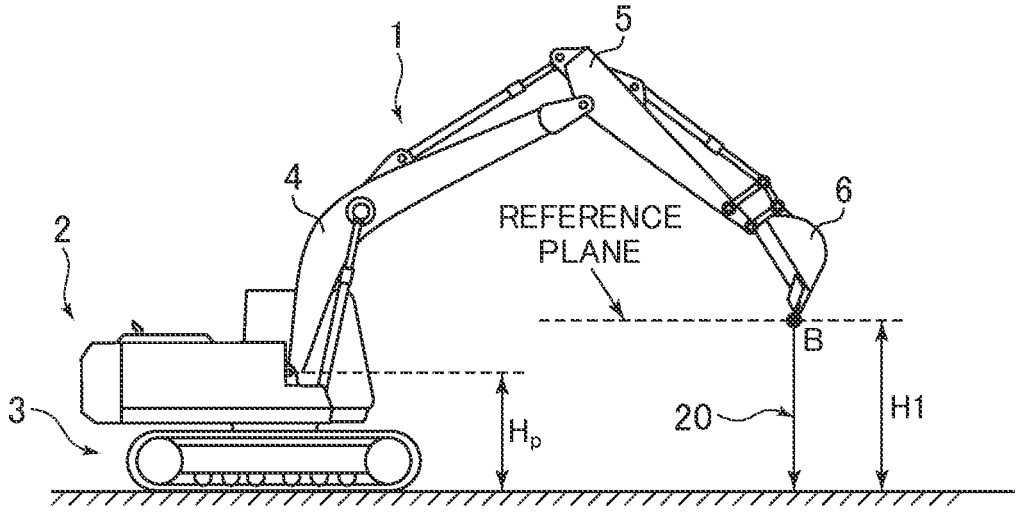
FIG. 10 is a diagram depicting an example of a relationship between a reference plane and the posture of the front implement in the case of capturing the posture angles.

For example, as depicted in FIG. 10, the posture angles $\theta_{bm}$, $\theta_{am}$, and $\theta_{bk}$ may be captured in a state in which a weighted string 20 (so-called plumb bob) at a length H1 is mounted to the claw tip of the bucket 6 (that is, the reference point B), the plumb bob 20 completely extends vertically, and a tip end (lower end) of the plumb bob 20 comes in contact with the ground, that is, the tip end (lower end) matches the reference plane. The weighted string 20 is a reference point relative index that indicates a position apart from the reference point B by a preset distance H1 in a vertically downward direction.

Since the claw tip position (reference point B) is a position higher than the ground (reference plane) by H1 at this time, the following Equation (6) is established.

[Equation 6]

$$z_{set}=H1-Hp \tag{6}$$

The present modification can compute the calibration parameters $\theta^s_{bm}$, $\theta^s_{am}$, and $\theta^s_{bk}$ more effectively since the front implement 1 can take more postures by changing the length of the weighted string 20. In this case, similarly to Embodiment 1, the posture of the front implement is influenced by irregularities of the ground; thus, it is preferable to capture the posture angles $\theta_{bm}$, $\theta_{am}$, and $\theta_{bk}$ while the ground paved with the concrete, the iron plate, or the like is assumed as the reference plane.

Figure 11:
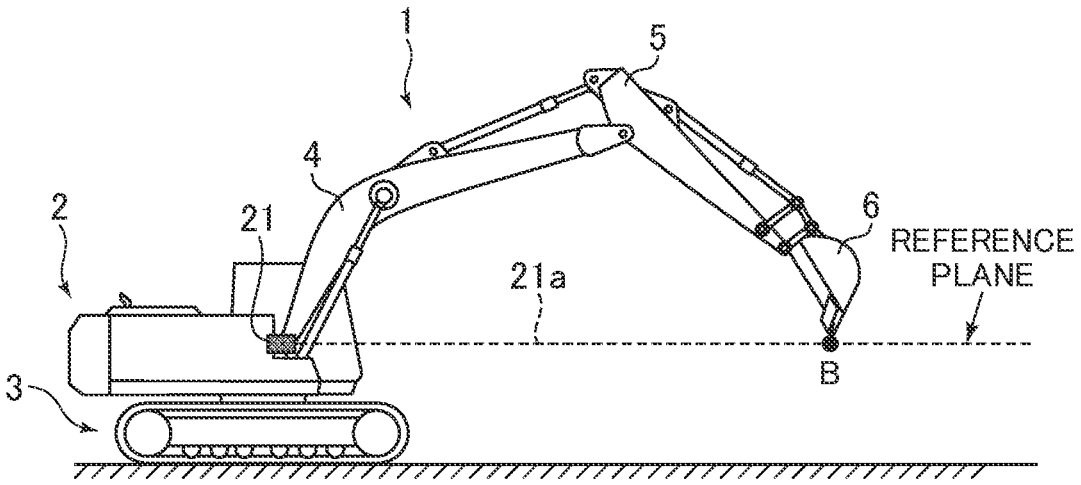
FIG. 11 is a diagram depicting an example of a relationship between the reference plane and the posture of the front implement in the case of capturing the posture angles.

Moreover, as depicted in FIG. 11, the posture angles $\theta_{bm}$, $\theta_{am}$, and $\theta_{bk}$ may be captured in a state in which a laser emitter 21 is provided at a position of a height of the boom foot pin, a laser beam 21*a* extending in the horizontal direction with respect to the height of the boom foot pin is assumed as the reference plane, and the claw tip position (reference point B) matches the reference plane. The laser emitter 21 is a reference plane index that visually indicates the position of the reference plane by the laser beam 21*a*.

Since the claw tip position (reference point B) is identical to the height of the boom foot pin (that is, height of the origin O of the front implement coordinate system) at this time, the following Equation (7) is established.

[Equation 7]

$$z_{set}=0 \tag{7}$$

The present modification has an advantage in that no irregularities are generated on the reference plane, unlike the case of assuming the ground as the reference plane.

Figure 12:
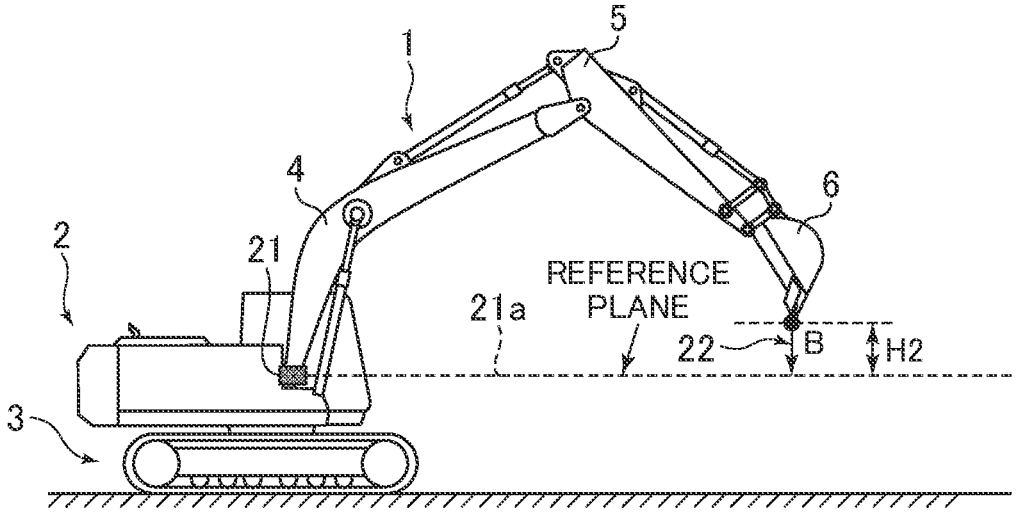
FIG. 12 is a diagram depicting an example of a relationship between the reference plane and the posture of the front implement in the case of capturing the posture angles.

As depicted in FIG. 12, the posture angles $\theta_{bm}$, $\theta_{am}$, and $\theta_{bk}$ may be captured in a state in which a plumb bob 22 at a length H2 is mounted to the claw tip of the bucket 6 (that is, the reference point B), the plumb bob 22 completely extends vertically, and a tip end (lower end) of the plumb bob 22 matches the reference plane (laser beam 21*a*).

Since the claw tip position (reference point B) is the position higher than the height of the boom foot pin (that is, height of the origin O of the front implement coordinate system) by H2 at this time, the following Equation (8) is established.

[Equation 8]

$$z_{set}=\mathrm{H2} \tag{8}$$

A mounting position of the laser emitter 21 can be set to an arbitrary height from the height of the boom foot pin. In this case, a mounting height of the laser emitter 21 from the boom foot pin (origin O of the front implement coordinate system) may be added to the right side of Equation (7) or (8).

Figure 13:
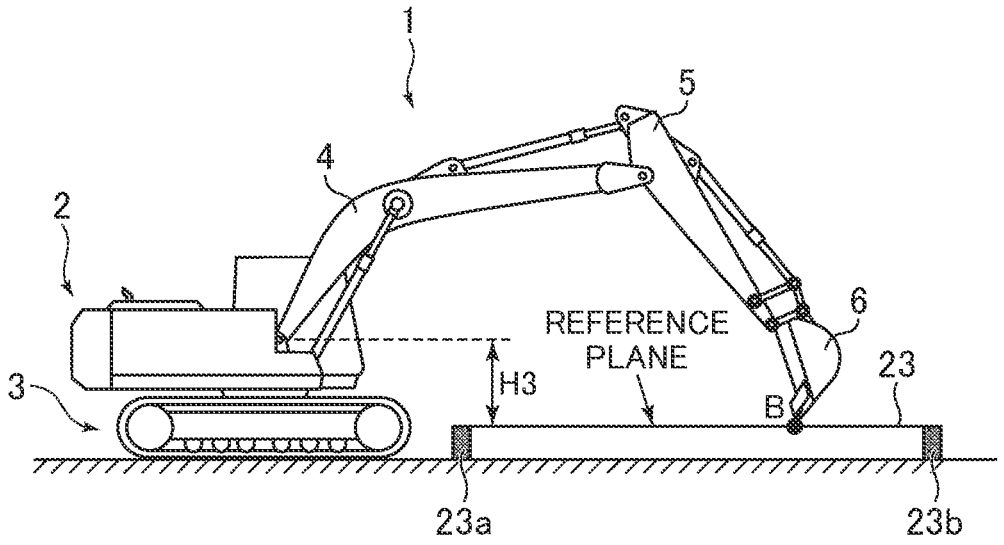
FIG. 13 is a diagram depicting an example of a relationship between the reference plane and the posture of the front implement in the case of capturing the posture angles.

Moreover, as depicted in FIG. 13, the posture angles $\theta_{bm}$, $\theta_{am}$, and $\theta_{bk}$ may be captured in a state in which a leveling line 23 is stretched horizontally between reference members 23*a* and 23*b* at a position lower than the position of the height of the boom foot pin by a preset height, and the claw tip position (reference point B) matches this leveling line 23 assumed as the reference plane.

Since the position of the reference plane (leveling line 23) and the claw tip position (reference point B) are the position lower than the origin O of the front implement coordinate system by H3 at this time, the following Equation (9) is established.

[Equation 9]

$$z_{set}=-H3 \tag{9}$$

The present modification has similarly an advantage in that no irregularities are generated on the reference plane, unlike the case of assuming the ground as the reference plane.

Embodiment 2

Embodiment 2 will be described with reference to FIG. 14.

In Embodiment 2, a case of disposing the hydraulic excavator 100 according to Embodiment 1 on a sloping surface and assuming this sloping surface as the reference plane will be given by way of example.

Figure 14:
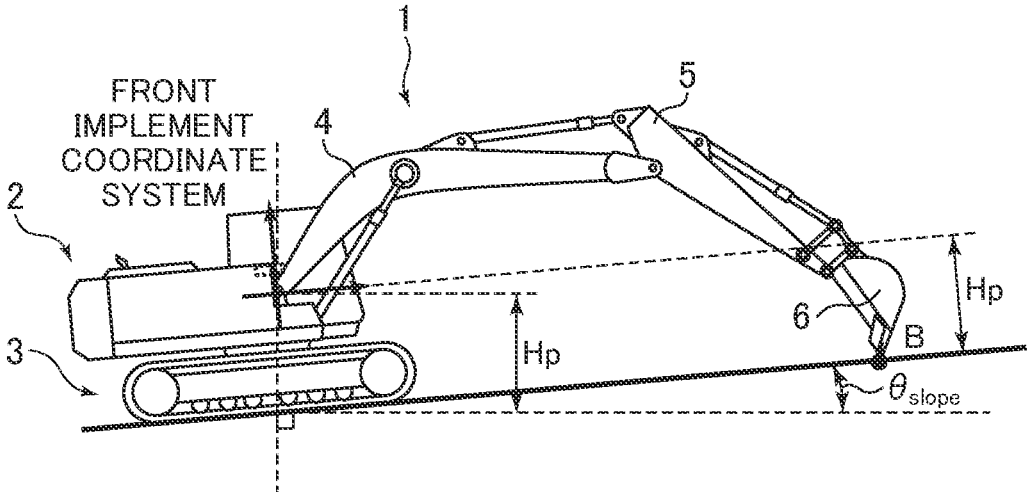
FIG. 14 is a side view schematically depicting a relationship between a front implement coordinate system and a hydraulic excavator according to Embodiment 2.

FIG. 14 is a side view schematically depicting a relationship between a front implement coordinate system defined in Embodiment 2 and the hydraulic excavator. In FIG. 14, similar members to those in Embodiment 1 are denoted by the same reference symbols and description thereof will be omitted.

As depicted in FIG. 14, in a case in which the hydraulic excavator 100 is disposed on a sloping surface sloping by $\theta_{slope}$ in such a manner as to be higher toward a front of the upper swing structure 2 (that is, toward the front implement 1), and in which the reference plane setting section 152 (sloping reference plane computing section) sets this sloping surface as the reference plane, the front implement coordinate system rotates by $\theta_{slope}$ about the origin O, compared with a case of setting the generally level ground as the reference plane. At this time, the direction of the gravitational accelerations detected by the inertial measurement units 14 to 16 (that is, vertically downward direction) also rotates by $(-\theta_{slope})$, the coordinates of the front implement coordinate system are adjusted by the following Equation (10) for Equations (2) and (3) for giving the reference point B in the front implement coordinate system using a slope $\theta_{slope}$ of the upper swing structure 2 (machine body) measured by the machine body inertial measurement unit 12.

[Equation 10]

$$\begin{bmatrix} x1 \\ z1 \end{bmatrix} = \begin{bmatrix} \cos\theta_{slope} & -\sin\theta_{slope} \\ \sin\theta_{slope} & \cos\theta_{slope} \end{bmatrix} \begin{bmatrix} x \\ z \end{bmatrix} \tag{10}$$

In Equation (10), it is assumed herein that coordinates of the front implement coordinate system before adjustment are (x, y) and coordinates of the front implement coordinate system after adjustment are (x1, y1).

The other configurations are similar to those in Embodiment 1.

Embodiment 2 configured as described above can obtain similar effects to those of Embodiment 1.

Furthermore, even in a case of disposing the hydraulic excavator 100 on the sloping surface and carrying out work, it is possible to compute the calibration parameters $\theta^s_{bm}$, $\theta^s_{am}$, and $\theta^s_{bk}$, and to carry out the work by appropriately calculating the claw tip position of the bucket 6 (reference point B) in the front implement coordinate system.

Embodiment 3

Embodiment 3 will be described with reference to FIGS. 15 to 19.

In Embodiment 3, in a state in which causing the driven member to which one of the plurality of calibration parameters $\theta^s_{bm}$, $\theta^s_{am}$, and $\theta^s_{bk}$ corresponds to take a posture in which the corresponding calibration parameter $\theta^s$ can be estimated to be close to 0 (that is, a posture in which an error is considered to be difficult to generate), the calibration parameters $\theta^s$ of the other driven members are computed, and the calibration parameter $\theta^s$ of the one driven member which is not computed is then computed, thereby enhancing the precision of the calibration parameters $\theta^s$.

Figure 15:
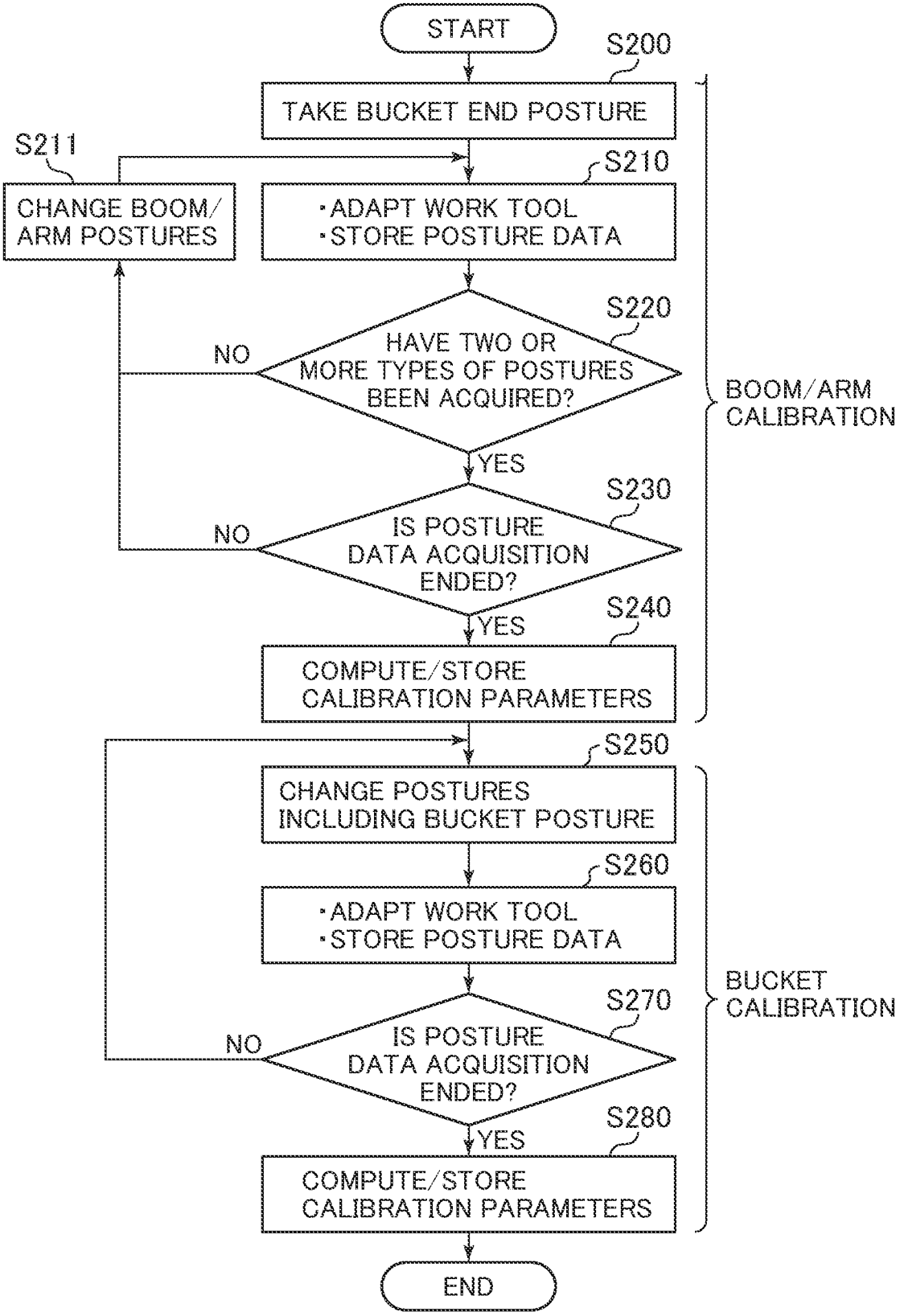
FIG. 15 is a flowchart depicting a posture computation process according to Embodiment 3.
Figure 16:
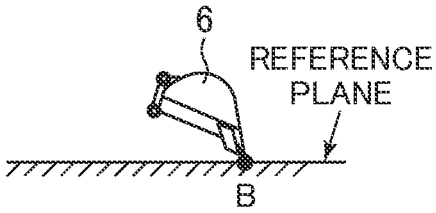
FIG. 16 is a diagram depicting an example of a posture of a bucket with respect to the reference plane.
Figure 17:
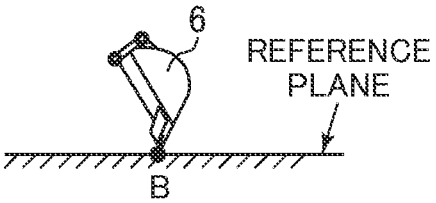
FIG. 17 is a diagram depicting an example of the posture of the bucket with respect to the reference plane.
Figure 18:
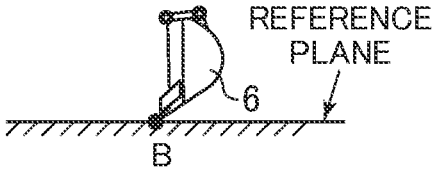
FIG. 18 is a diagram depicting an example of the posture of the bucket with respect to the reference plane.
Figure 19:
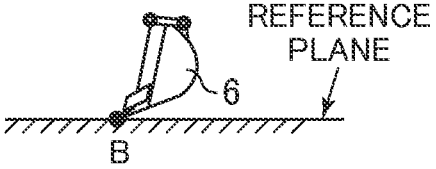
FIG. 19 is a diagram depicting an example of the posture of the bucket with respect to the reference plane.

FIG. 15 is a flowchart depicting the posture computation process according to Embodiment 3. In addition, FIGS. 16 to 19 are diagrams each depicting an example of the posture of the bucket with respect to the reference plane.

In FIG. 15, first, the bucket 6 takes a bucket end posture in which the bucket cylinder 6*a* completely extends or completely contracts (Step S200). It is noted that the posture of the bucket 6 at this time may be the posture in which the calibration parameter $\theta^s_{bk}$ can be estimated to be close to zero (that is, the posture in which an error is considered to be difficult to generate).

By adapting the reference point B of the work tool (bucket 6) to the reference plane and operating the computation posture setting section 18 in this state, the posture angles $\theta_{bm}$ and $\theta_{am}$ are captured as the posture data in this posture and stored in the storage section, not depicted, in the calibration value computing section 153 (S210). If the posture angle of the bucket 6 in the bucket end posture is assumed as $\theta^{end}_{bk}$, the height of the reference point B in the front implement coordinate system is given by the following Equation (11).

[Equation 11]

$$z_{set}=L_{bm}\sin(\theta_{bm}-\theta^s_{bm})+L_{am}\sin(\theta_{am}-\theta^s_{am})+L_{bk}\sin(\theta_{bk}^{end}) \quad (11)$$

Next, it is determined whether the posture data has been acquired in equal to or larger than two types of postures of the front implement 1 (Step S220). In a case in which a determination result is NO, the postures of the boom 4 and the arm 5 of the front implement 1 are changed to other postures in which posture data is not acquired yet while the bucket end posture is kept (Step S211) and processes in Steps S210 and S220 are repeated. Furthermore, in a case in which the determination result of Step S220 is YES, it is determined whether to end posture data acquisition (Step S230). In a case in which a determination result of Step S230 is NO, processes of Steps S211 and S210 are repeated. Furthermore, in a case in which the determination result of Step S230 is YES, then simultaneous equations related to Equation (10) are set up using the obtained posture angles $\theta_{bm}$ and $\theta_{am}$ and the posture angle $\theta^{end}_{bk}$, the calibration parameters $\theta^s_{bm}$ and $\theta^s_{am}$ are computed and stored in the calibration value computing section 153, and a computation result is output to the work position computing section 154 (Step S240).

Next, by changing the posture of the front implement 1 including the bucket 6 (Step S250), adapting the reference point B of the work tool (bucket 6) to the reference plane, and operating the computation posture setting section 18, the posture angles $\theta_{bm}$, $\theta_{am}$, and $\theta_{bk}$ are captured as the posture data in this posture and stored in the storage section, not depicted, in the calibration value computing section 153 (S260).

Here, if it is assumed that the calibration parameters of the boom 4 and the arm 5 computed in S240 are $\theta^{set}_{bm}$ and $\theta^{set}_{am}$, the height of the reference point B in the front implement coordinate system is given by the following Equation (12).

[Equation 12]

$$z_{set}=L_{bm}\sin(\theta_{bm}-\theta_{bm}^{set})+L_{am}\sin(\theta_{am}-\theta_{am}^{set})+L_{bk}\sin(\theta_{bk}-\theta_{bk}^{s}) \quad (12)$$

Next, it is determined whether to end posture data acquisition (Step S270). In a case in which a determination result of Step S270 is NO, processes of Steps S250 and S260 are repeated. Furthermore, in a case in which the determination result of Step S270 is YES, then simultaneous equations related to Equation (12) are set up using the obtained posture angles $\theta_{bm}$, $\theta_{am}$, and $\theta_{bk}$, the calibration parameter $\theta^s_{bk}$ is computed and stored in the calibration value computing section 153, a computation result is output to the work position computing section 154 (Step S280), and the process is ended.

While the calibration parameter $\theta^s_{bk}$ can be computed by performing the processes in Steps S250 and S260 equal to or larger than one time, it is possible to enhance the precision of the calibration parameter $\theta^s_{bk}$ by changing the posture of the bucket 6 and acquiring a plurality of posture angles $\theta_{bk}$ as depicted in, for example, FIGS. 16 to 19. It is noted that FIGS. 16 to 19 depict only the bucket 6 in the posture in which the claw tip (reference point B) is adapted to the reference plane and do not depict the other configurations such as the arm 5.

The other configurations are similar to those in Embodiment 1.

Embodiment 3 configured as described above can obtain similar effects to those of Embodiment 1.

Furthermore, while the calibration parameters of the boom 4, the arm 5, and the bucket 6 are simultaneously calculated in Embodiment 1, it is impossible to strictly suit sensor offsets of the inertial measurement units 14 to 16 (calibration parameters $\theta^s_{bm}$, $\theta^s_{am}$, and $\theta^s_{bk}$). For example, it is conceivable that a change $L_{bk}\sin\theta_{bk}$ in the height of the claw tip position (reference point B) by the sensor offset (calibration parameter $\theta^s_{bk}$) of the bucket 6 is canceled by an amount of change $L_{bm}\sin\theta^s_{bm}+L_{am}\sin\theta^s_{am}$ in the height of the claw tip position (reference point B) by the sensor offsets (calibration parameters $\theta^s_{bm}$ and $\theta^s_{am}$) of the boom 4 and the arm 5. Such a phenomenon possibly causes a reduction in estimation precision of the position of the reference point of the work tool in the posture of the front implement 1 that is not adopted at the time of acquiring the posture angles $\theta_{bm}$, $\theta_{am}$, and $\theta_{bk}$.

Embodiment 3 is made in the light of the above phenomenon in Embodiment 1. In other words, Equation (11) includes only the calibration parameters $\theta^s_{bm}$ and $\theta^s_{am}$ of the boom 4 and the arm 5 as unknown variables, and the posture angle of the bucket 6 can be made constant to $\theta^{end}_{bk}$. Therefore, it is difficult to include the influence of the sensor offset (calibration parameter $\theta^s_{bk}$) of the bucket 6 in the sensor offset (calibration parameter $\theta^s_{bm}$) of the boom 4 and the sensor offset (calibration parameter $\theta^s_{am}$) of the arm 5 unlike Embodiment 1, and it is possible to suppress the reduction in the estimation precision of the position of the reference point of the work tool in the posture of the front implement 1 that is not adopted at the time of acquiring the posture angles $\theta_{bm}$, $\theta_{am}$, and $\theta_{bk}$.

Embodiment 4

Embodiment 4 will be described with reference to FIGS. 20 to 25.

In Embodiment 4, a posture angle is acquired in a posture in which each of coupling portions of coupling the plurality of driven members 4 to 6 configuring the front implement 1 and the reference point (or the plumb bob that is the reference point relative index provided at any of the coupling portions or the reference point) matches the reference plane, and each calibration parameter is computed, whereby the influence of the sensor offsets of the other driven members is mitigated and the precision of the calibration parameters is enhanced.

Figure 20:
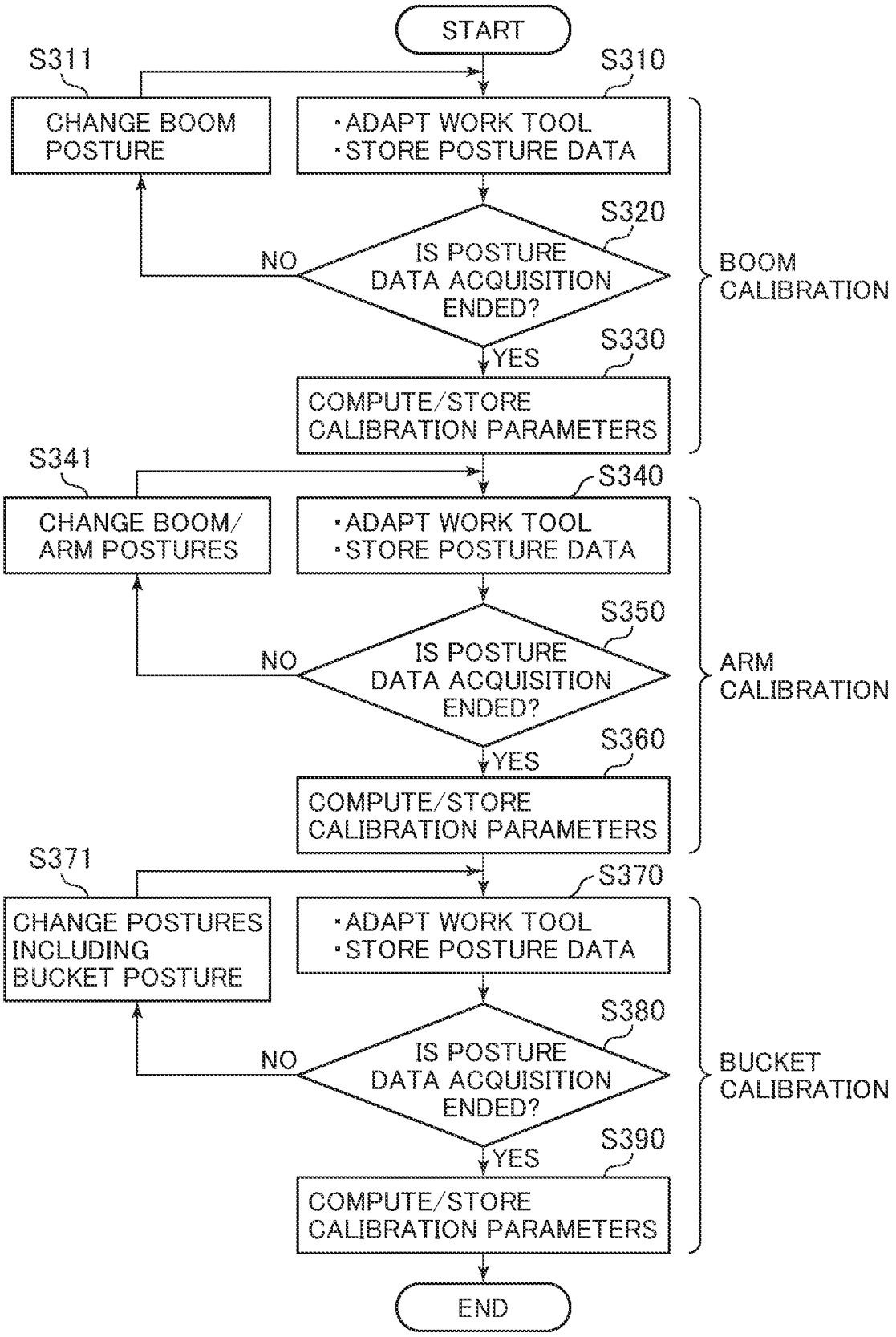
FIG. 20 is a flowchart depicting a posture computation process according to Embodiment 4.
Figure 21:
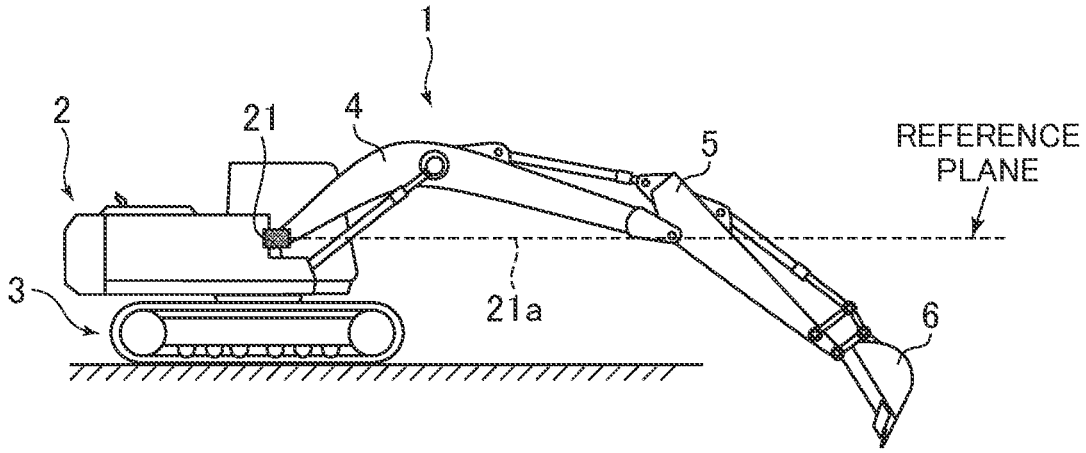
FIG. 21 is a diagram depicting a posture with a boom tip end adapted to the reference plane.
Figure 22:
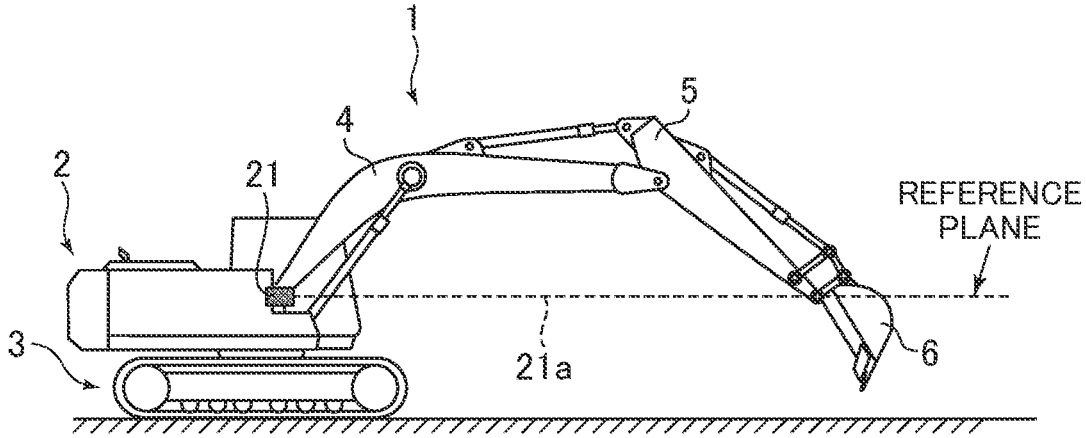
FIG. 22 is a diagram depicting a posture with an arm tip end adapted to the reference plane.
Figure 23:
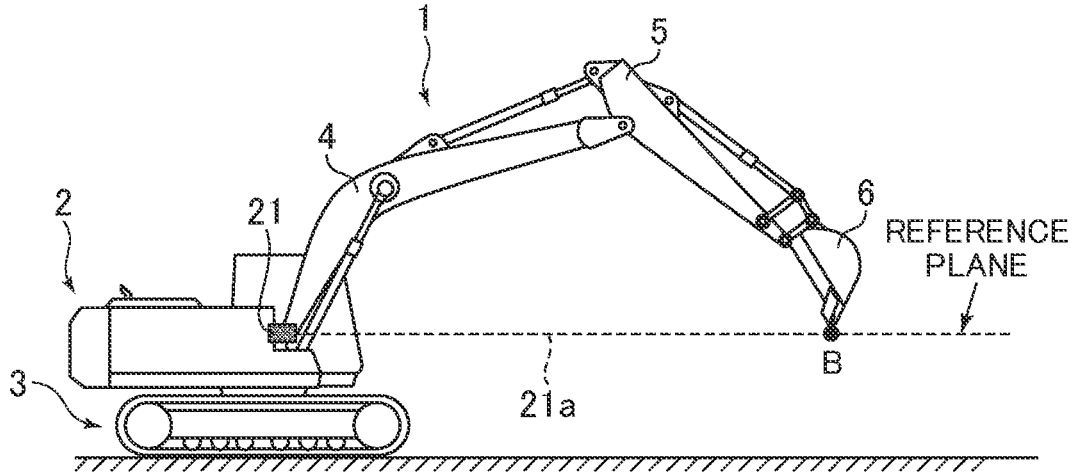
FIG. 23 is a diagram depicting a posture with a bucket tip end adapted to the reference plane.

FIG. 20 is a flowchart depicting the posture computation process in Embodiment 4. In addition, FIGS. 21 to 23 are diagrams each depicting a posture in which each of the coupling portions of coupling the driven members and the reference point matches the reference plane. FIG. 21 is a diagram depicting a posture in which a boom tip end matches the reference plane, FIG. 22 is a diagram depicting a posture in which an arm tip end matches the reference plane, and FIG. 23 is a diagram depicting a posture in which the bucket tip end matches the reference plane.

In Embodiment 4, the laser emitter 21 is provided at the position of the height of the boom foot pin and the laser beam 21*a* extending in the horizontal direction with respect to the height of the boom foot pin is assumed as the reference plane.

In FIG. 20, first, adapting the tip end of the boom 4 (coupling portion of coupling the boom 4 and the arm 5) to the reference plane (refer to FIG. 21) and operating the computation posture setting section 18, the posture angle $\theta_{bm}$ is captured as posture data in this posture and stored in the storage section, not depicted, in the calibration value computing section 153 (Step S310). At this time, a height $z_a$ of the tip end of the boom 4 in the front implement coordinate system is given by the following Equation (13).

[Equation 13]

$$z_a = L_{bm} \sin(\theta_{bm} - \theta^s_{bm}) \tag{13}$$

Since the height of the reference plane is identical to the height of the origin O of the front implement coordinate system, $z_a = 0$ (zero).

Next, it is determined whether to end posture data acquisition (Step S320). In a case in which a determination result of Step S320 is NO, then the posture of the boom 4 is changed to another posture in which posture data is not acquired yet (Step S311), and the process in Step S310 is repeated. In a case of adapting the tip end of the boom 4 to the reference plane, the boom 4 can take only one posture; thus, the posture data is acquired by providing a plumb bob at a known length on the tip end of the boom 4 and adapting this plumb bob to the reference plane. Needless to say, in this case, a value of $z_a$ is adjusted to the length of the plumb bob.

Furthermore, in a case in which the determination result of Step S320 is YES, then the calibration parameter $\theta^s_{bm}$ is computed from Equation (13) using the obtained posture angle $\theta_{bm}$ and stored in the calibration value computing section 153, and a computation result is output to the work position computing section 154 (Step S330).

Next, adapting the tip end of the arm 5 (coupling portion of coupling the arm 5 and the bucket 6) to the reference plane (refer to FIG. 22) and operating the computation posture setting section 18, the posture angle $\theta_{am}$ is captured as posture data in this posture and stored in the storage section, not depicted, in the calibration value computing section 153 (Step S340). At this time, a height $z_a$ of the tip end of the arm 5 in the front implement coordinate system is given by the following Equation (14) with the calibration parameter of the boom 4 obtained in Step S330 assumed as $\theta^{set}_{bm}$.

[Equation 14]

$$z_a = L_{bm} \sin(\theta_{bm} - \theta_{bm}^{set}) + L_{am} \sin(\theta_{am} - \theta_{am}^{s}) \tag{14}$$

Next, it is determined whether to end posture data acquisition (Step S350). In a case in which a determination result of Step S350 is NO, then the postures of the boom 4 and the arm 5 are changed to other postures in which posture data is not acquired yet (Step S341), and the process in Step S340 is repeated. Furthermore, in a case in which the determination result of Step S350 is YES, then the calibration parameter $\theta^s_{am}$ is computed from Equation (13) using the obtained posture angles $\theta_{bm}$ and $\theta_{am}$ and stored in the calibration value computing section 153, and a computation result is output to the work position computing section 154 (Step S360).

Next, by adapting the tip end of the bucket 6 (reference point B) to the reference plane (refer to FIG. 23) and operating the computation posture setting section 18, the posture angles $\theta_{bm}$ and $\theta_{am}$, and $\theta_{bk}$ are captured as the posture data in this posture and stored in the storage section, not depicted, in the calibration value computing section 153 (S370). At this time, the height $z_{set}$ of the tip end of the bucket 6 (reference point B) in the front implement coordinate system is given by Equation (12) with the calibration parameters of the boom 4 and the arm 5 obtained in Steps S330 and S360 assumed as $\theta^{set}_{bm}$ and $\theta^{set}_{am}$.

Next, it is determined whether to end posture data acquisition (Step S380). In a case in which a determination result of Step S380 is NO, then the posture of the front implement 1 is changed to another posture in which posture data is not acquired yet (Step S371), and the process in Step S370 is repeated. Furthermore, in a case in which the determination result of Step S380 is YES, then the calibration parameter $\theta^s_{bk}$ is computed from Equation (11) using the obtained posture angles $\theta_{bm}$, $\theta_{am}$, and $\theta_{bk}$ and stored in the calibration value computing section 153, and a computation result is output to the work position computing section 154 (Step S390).

While the calibration parameters $\theta^s_{bm}$, $\theta^s_{am}$, and $\theta^s_{bk}$ can be computed by performing each of the processes in Steps S310, S340, and S370 equal to or larger than one time, it is possible to enhance the precision of the calibration parameters $\theta^s_{bm}$, $\theta^s_{am}$, and $\theta^s_{bk}$ by changing the postures of the driven members 4 to 6 and acquiring a plurality of posture angles $\theta_{bm}$, $\theta_{am}$, and $\theta_{bk}$.

The other configurations are similar to those in Embodiment 1.

Embodiment 4 configured as described above can obtain similar effects to those of Embodiment 1.

Furthermore, while it is conceivable that the influence of an interaction among the boom 4, the arm 5, and the bucket 6 cannot be completely mitigated in Embodiment 2, the calibration parameters of the boom 4, the arm 5, and the bucket 6 are computed individually and it is, therefore, possible to expect improvement in posture estimation precision in a wide range in Embodiment 4.

Figure 24:
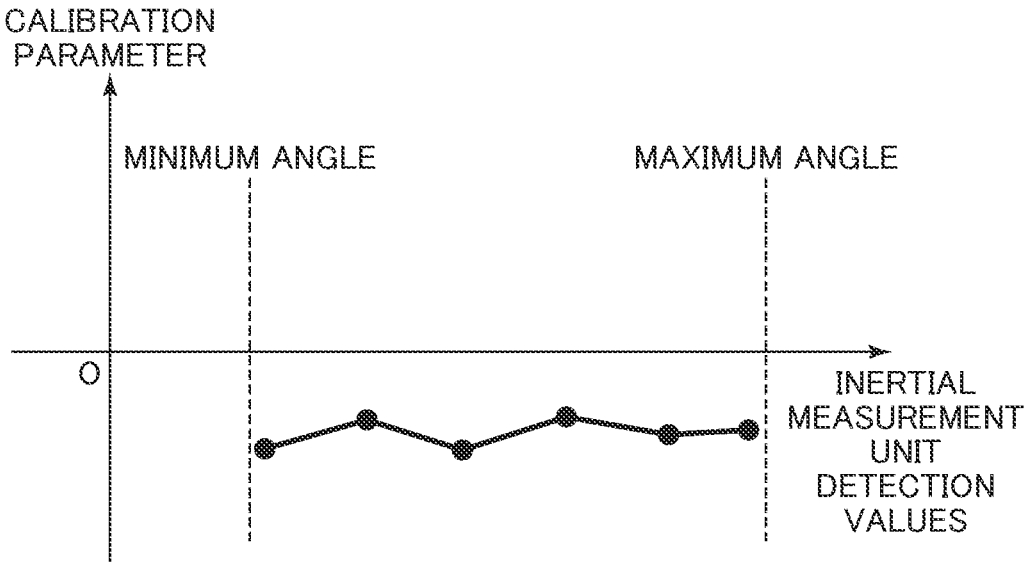
FIG. 24 is a diagram depicting a calibration table of calibration parameters linearly interpolated in each section.
Figure 25:
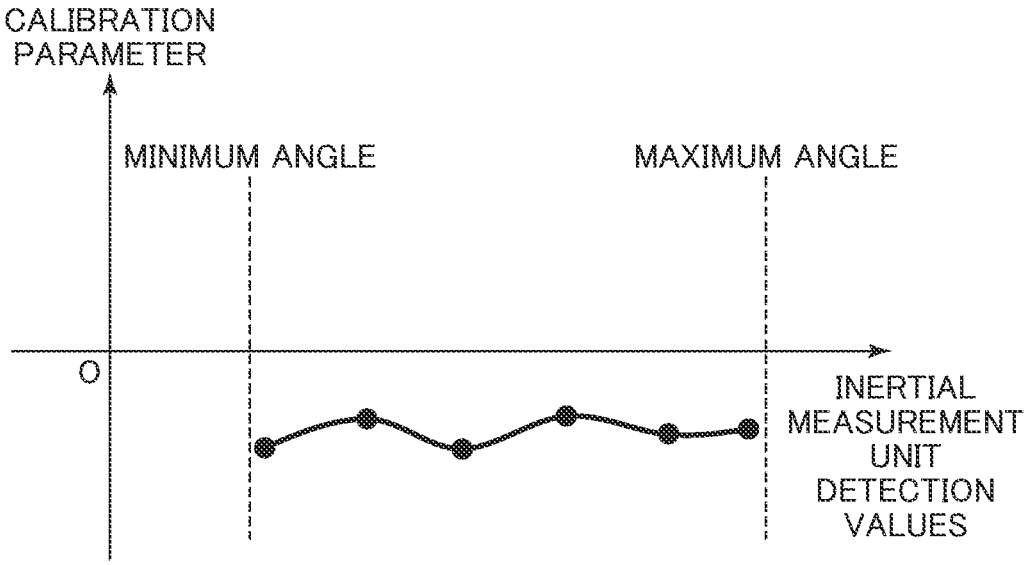
FIG. 25 is a diagram depicting a calibration table of smoothing the calibration parameters in all possible angle sections.

While the case on the premise that the calibration parameters $\theta^s_{bm}$, $\theta^s_{am}$, and $\theta^s_{bk}$ are given as constant values has been described in Embodiment 4, the hydraulic excavator 100 may be configured such that calibration tables indicating a relationship between the detection values of the inertial measurement units 14 to 16 and the calibration parameters $\theta^s_{bm}$, $\theta^s_{am}$, and $\theta^s_{bk}$ are created, and the calibration parameters are determined in response to the detection values of the inertial measurement units 14 to 16, as depicted in, for example, FIGS. 24 and 25. In other words, in a case in which the calibration parameters $\theta^s_{bm}$, $\theta^s_{am}$, and $\theta^s_{bk}$ of the boom 4, the arm 5, and the bucket 6 can be computed individually as described in Embodiment 4, calibration tables depicted in FIGS. 24 and 25 can be created. Configuring the hydraulic excavator 100 as described above makes it possible to expect realization of higher precision posture estimation. In FIGS. 24 and 25, a plot point denotes the calibration parameter obtained in each posture. FIG. 24 depicts a case of linearly interpolating the calibration parameter per section, and FIG. 25 depicts a case of smoothing the calibration parameter in all possible angle sections.

Features of Embodiments 1 to 4 and the modification will next be described.

(1) In Embodiments 1 to 4, a construction machine (for example, hydraulic excavator 100) includes: a multijoint type front work implement 1 that is configured by coupling a plurality of driven members (for example, a boom, an arm 5, and a bucket 6) including a work tool (for example, the bucket 6) and that is supported by a machine body (for example, an upper swing structure 2) of the construction machine in such a manner as to be rotatable in a perpendicular direction; posture information sensors (for example, inertial measurement units 14 to 16) that detect posture information about the plurality of driven members; and a front posture computing device (for example, a posture computing device 154) that computes a posture of the multijoint type front work implement on the basis of detection information from the posture information sensors, an action of the multijoint type front work implement being controlled on the basis of the posture of the multijoint type front work implement computed by the front posture computing device. The construction machine is configured in such a manner that the front posture computing device includes: a reference position setting section (for example, a reference plane setting section 152) that sets a reference position (for example, a reference plane) specified relatively to the machine body; a calibration value computing section 153 that computes calibration parameters used in calibration of the detection information from the posture information sensors; and a work position computing section 154 that computes a relative position of the work tool to the machine body on the basis of the detection information from the posture information sensors and a computation result of the calibration value computing section. Further, the construction machine is configured in such a manner that the calibration value computing section computes the calibration parameters on the basis of the detection information from the posture information sensors in a plurality of postures of the front work implement in which a reference point set on any of the plurality of driven members in advance matches the reference position set by the reference position setting section, which differ in a posture of at least one of the plurality of driven members, and the number of which corresponds to the number of the driven members.

Configuring the construction machine in this way makes it possible to highly precisely compute the posture of the work implement with a simpler configuration.

(2) Furthermore, in Embodiments 1 to 4, the construction machine according to (1) is configured such that the reference position setting section sets a reference plane parallel to a horizontal surface as the reference position, and the calibration value computing section computes the calibration parameters on the basis of the detection information from the posture information sensors in a plurality of postures of the front work implement in which the reference point set on any of the plurality of driven members in advance matches any of positions on the reference plane, which differ in the posture of at least one of the plurality of driven members, and the number of which corresponds to the number of the driven members.

Setting the reference position to the reference plane parallel to the horizontal surface in this way makes it possible to facilitate adapting the reference point of any of the driven members to the reference position (reference plane) and to facilitate performing posture computation.

(3) Moreover, in Embodiments 1 to 4, the construction machine according to (2) includes: a machine body sloping detection section that detects a slope angle of the machine body with respect to the horizontal surface; and a sloping reference plane computing section that computes a sloping reference plane obtained by sloping the reference plane on the basis of the slope angle of the machine body detected by the machine body sloping detection section, is configured such that the calibration value computing section computes the calibration parameters on the basis of the detection information from the posture information sensors in a plurality of postures of the front work implement in which the reference point set on any of the plurality of driven members in advance matches any of positions on the sloping reference plane, which differ in the posture of at least one of the plurality of driven members, and the number of which corresponds to the number of the driven members.

By so configuring, even in the case of disposing the hydraulic excavator 100 on the sloping surface and carrying out work, it is possible to compute the calibration parameters $\theta^s_{bm}$, $\theta^s_{am}$, and $\theta^s_{bk}$, and to carry out the work by appropriately calculating the claw tip position of the bucket 6 (reference position B) in the front implement coordinate system.

(4) Furthermore, in Embodiments 1 to 4, the construction machine according to (2) is configured such that the reference position is made to match a position on the reference plane by causing the reference point set on any of the plurality of driven members in advance to match a reference plane index that visually indicates a position of the reference plane.

It is thereby possible to set the mounting position of the laser emitter 21 that emits the laser beam 21*a* at an arbitrary height; thus, it is possible to set the reference plane (laser beam 21*a*) at an arbitrary height. Furthermore, no irregularities are generated on the reference plane since the laser beam 21*a*has a high ability to travel in a straight line.

(5) Moreover, in Embodiments 1 to 4, the construction machine according to (1) is configured such that the calibration value computing section computes the calibration parameters on the basis of the detection information from the posture information sensors in a plurality of postures of the front work implement in which a reference point relative index that indicates a position apart from the reference point set on any of the plurality of driven members in advance in a vertically downward direction matches the reference position, which differ in the posture of at least one of the plurality of driven members, and the number of which corresponds to the number of the driven members.

By so configuring, it is possible to compute the calibration parameters $\theta^s_{bm}$, $\theta^s_{am}$, and $\theta^s_{bk}$ more effectively since the front implement 1 can take more postures by changing the length of the plumb bob 20.

(6) Further, in Embodiments 1 to 4, the construction machine according to (1) is configured such that the calibration value computing section creates a calibration parameter table to which the detection information from the posture information sensors is input and which outputs the calibration parameters that are the computation result of the calibration value computing section, and that the work position computing section computes relative positions of the plurality of driven members to the machine body on the basis of the detection information from the posture information sensors and on the basis of the calibration parameters output from the calibration parameter table on the basis of the detection information from the posture information sensors.

<Note>

It is noted that the ordinary hydraulic excavator that drives the hydraulic pump by the prime mover such as the engine has been described in Embodiments 1 to 3 and the modification by way of example. Needless to say, the present invention can be applied to a hybrid hydraulic excavator that drives a hydraulic pump by an engine and a motor, a motorized hydraulic excavator that drives a hydraulic pump only by a motor, or the other hydraulic excavator.

Furthermore, the present invention is not limited to Embodiments 1 to 3 and the modification but encompasses various modifications and combinations without departing from the gist of the invention. Moreover, the present invention is not limited to the work machine that includes all the configurations described in Embodiments 1 to 3 and the modification but encompasses those from which a part of the configurations is deleted. Furthermore, the configurations, the functions, and the like described above may be realized by, for example, designing a part or all thereof with integrated circuits. Moreover, the configurations, functions, and the like described above may be realized by software by causing a processor to interpret and execute programs that realize the respective functions.

REFERENCE SIGNS LIST

1 front implement (front work implement)
2 upper swing structure
2*a* swing motor
3 lower travel structure
3*a* travel motor
4 boom
4*a* boom cylinder
5 arm
5*a* arm cylinder
6 bucket
6*a* bucket cylinder
7 hydraulic pump device
8 control valve
9 cabin
9*a*, 9*b* operation lever (operation device)
12 inertial measurement unit
14 boom inertial measurement unit
15 arm inertial measurement unit
15*a*, 15A posture computing device
15*b* monitor display control system
15*c* hydraulic system control system
15*d* work execution target surface computing device
16 bucket inertial unit
17 work execution information
18 computation posture setting section
19 controller
20, 22 plumb bob
21 laser emitter
21*a* laser beam
23 leveling line
23*a*, 23*b* reference member
100 hydraulic excavator
151, 151*a* design information storage section
152 reference plane setting section
153 calibration value computing section
154 work position computing section

The invention claimed is:

1. A construction machine comprising:

a multijoint type front work implement that is configured by coupling a plurality of driven members including a work tool and that is supported by a machine body of the construction machine in such a manner as to be rotatable in a perpendicular direction;

posture information sensors that detect posture information about the plurality of driven members; and a front posture computing device that computes a posture of the multijoint type front work implement on the basis of detection information from the posture information sensors, an action of the multijoint type front work implement being controlled on the basis of the posture of the front work implement computed by the front posture computing device, wherein the front posture computing device includes a reference position setting section that sets a reference position specified relatively to the machine body;

a calibration value computing section that computes calibration parameters used in calibration of the detection information from the posture information sensors; and a work position computing section that computes a relative position of the work tool to the machine body on the basis of the detection information from the posture information sensors and a computation result of the calibration value computing section, and the calibration value computing section computes the calibration parameters on the basis of the detection information from the posture information sensors in a plurality of postures of the front work implement in which a reference point set on any of the plurality of driven members in advance matches the reference position set by the reference position setting section, which differ in a posture of at least one of the plurality of driven members, and the number of which corresponds to the number of the driven members.

2. The construction machine according to claim 1, wherein the reference position setting section sets a reference plane parallel to a horizontal surface as the reference position, and the calibration value computing section computes the calibration parameters on the basis of the detection information from the posture information sensors in a plurality of postures of the front work implement in which the reference point set on any of the plurality of driven members in advance matches any of positions on the reference plane, which differ in the posture of at least one of the plurality of driven members, and the number of which corresponds to the number of the driven members.

3. The construction machine according to claim 2, including:

a machine body sloping detection section that detects a slope angle of the machine body with respect to the horizontal surface; and a sloping reference plane computing section that computes a sloping reference plane obtained by sloping the reference plane on the basis of the slope angle of the machine body detected by the machine body sloping detection section, wherein the calibration value computing section computes the calibration parameters on the basis of the detection information from the posture information sensors in a plurality of postures of the front work implement in which the reference point set on any of the plurality of driven members in advance matches any of positions on the sloping reference plane, which differ in the posture of at least one of the plurality of driven members, and the number of which corresponds to the number of the driven members.

4. The construction machine according to claim 2, wherein the reference position is made to match a position on the reference plane by causing the reference point set on any of the plurality of driven members in advance to match a reference plane index that visually indicates a position of the reference plane.

5. The construction machine according to claim 1, wherein the calibration value computing section computes the calibration parameters on the basis of the detection information from the posture information sensors in a plurality of postures of the front work implement in which a reference point relative index that indicates a position apart from the reference point set on any of the plurality of driven members in advance in a vertically downward direction matches the reference position, which differ in the posture of at least one of the plurality of driven members, and the number of which corresponds to the number of the driven members.

6. The construction machine according to claim 1, wherein the calibration value computing section creates a calibration parameter table to which the detection information from the posture information sensors is input and which outputs the calibration parameters that are the computation result of the calibration value computing section, and the work position computing section computes relative positions of the plurality of driven members to the machine body on the basis of the detection information from the posture information sensors and on the basis of the calibration parameters output from the calibration parameter table on the basis of the detection information from the posture information sensors.

* * * * *